US005823708A

United States Patent [19]

Dwight et al.

[11] Patent Number: 5,823,708

[45] Date of Patent: Oct. 20, 1998

[54] DEVICE WHICH PROVIDES AN UNDERWATER DRY WORKSHOP ENVIRONMENT FOR SHIP PROPELLER INSPECTION AND REPAIR

[76] Inventors: John M. Dwight, 414 Hewitt Rd., Chehalis, Wash. 98532; Richard D. Benson, 3106 NW. 77th, Seattle, Wash. 98117

[21] Appl. No.: 587,421

[22] Filed: Jan. 16, 1996

[51] Int. Cl.[6] ..... B63C 11/40; B63C 11/00

[52] U.S. Cl. ..... 405/12; 114/221 R; 114/314; 405/8; 405/188

[58] Field of Search ..... 405/188–194, 405/8–14; 114/312–315, 221 A, 221 R, 222

[56] References Cited

U.S. PATENT DOCUMENTS

| | | | |
|---|---|---|---|
| 412,697 | 10/1889 | Clarke | 405/12 |
| 2,667,751 | 2/1954 | Osborn | 405/188 |
| 3,331,211 | 7/1967 | Cravens et al. | 405/12 |
| 3,466,880 | 9/1969 | Elliott | 405/12 X |
| 3,473,338 | 10/1969 | Pearce | 405/188 |
| 3,508,410 | 4/1970 | Lynch | 405/188 X |
| 3,543,526 | 12/1970 | O'Neill et al. | 405/188 X |
| 3,641,777 | 2/1972 | Banjavich et al. | 405/188 |
| 3,864,924 | 2/1975 | Piotin | 405/188 |
| 4,626,128 | 12/1986 | Devine | 405/12 |
| 5,324,140 | 6/1994 | Lopez et al. | 405/188 |

FOREIGN PATENT DOCUMENTS

| | | | |
|---|---|---|---|
| 8501262 | 3/1985 | WIPO | 405/188 |

*Primary Examiner*—Dennis L. Taylor
*Attorney, Agent, or Firm*—Thomas W. Secrest

[57] ABSTRACT

There is disclosed a means and a method for inspecting and repairing a propeller on a propeller shaft on a ship. The ship is in the water. A truss is positioned on the propeller shaft. A habitat bag is positioned over the upper part of the propeller and is attached to the truss. Then, the truss is inflated with air. An inspector and/or a repair person can enter into the habitat and work in a dry environment while the ship is in the water. There is no need, in many instances, to place the ship in a dry dock.

90 Claims, 11 Drawing Sheets

DEVICE WHICH PROVIDES AN UNDERWATER DRY WORKSHOP ENVIRONMENT FOR SHIP PROPELLER INSPECTION AND REPAIR

BACKGROUND OF THE INVENTION

1. Field of the Invention

This invention pertains to the inspection and/or repair of a propeller on a ship or boat while the ship or boat is in the water. The inspection and/or repair is conducted without the ship being in dry dock.

This invention pertains to underwater propeller inspection and repair methods which involve the deployment of a dry work chamber that is attached to the propeller shaft or the boss forward of the propeller and aft of the propeller and surrounds the top half of the propeller. Specifically, this invention allows a range of work, from inspections to major emergency repairs, to be carried out on propellers of various sizes in a dry work environment, without having to dry dock the ship.

2. Description of the Prior Art

The prior art of propeller repair allowed for only makeshift repairs to be performed while the ship was still afloat, as there had been no suitable dry work environment available to allow for precision repair or seal replacement while the ship was in the water. In the past, when a propeller had been damaged (i.e. bent or broken), the damaged section was cut off as precisely as possible by a diver in an attempt to balance the propeller. The propeller was then balanced by cutting about the same amount from the appropriate remaining propeller blades. Propeller blades were also straightened by diver operated hydraulic presses sometimes in conjunction with removing material by cutting or grinding. This method, though initially quick and cheap, is inefficient as it is extremely difficult to balance a propeller by "eyeballing it." This method also leads to more expense over a period of time. An improperly balanced propeller means running at slower speeds and risking damage to the propeller shaft and the bearings.

SUMMARY OF THE INVENTION

This invention provides a shirt-sleeve work shop environment that allows precision propeller repair without having to put the ship into dry dock. Since the propeller can be rotated while the work shop is attached, and because it is accessible by air lock, this submerged chamber or habitat provides an excellent inspection platform. This invention also provides a controlled environment for engineered welding repairs and precision heat straightening, enhanced by the capability for 3-D (three-dimensional) curved surface contour measurements using a digitizing arm and computer. The invention's advantages include its ability to adapt to a range of propeller sizes. The habitat can be broken down in components easily handled by the dive team.

The primary purpose of the habitat is to provide a shirt-sleeve environment for emergency propeller blade inspection. Various methods and levels of complexity will be available. Typically a visual with video will be a minimum. The customer, inspector, ABS inspector or ship owner could witness the inspection if desired. Since access to the inspection area is from the top of the habitat by air lock there is no need for diving during the inspection process. A simple face mask and emergency air pack can be carried by members of the inspection team.

It is anticipated that repairs can range from simple to complex. Minor surface conditions can be repaired by all conventional shop processes since the environment is air. Each blade can be rotated to a working position within the habitat chamber. Repairs can involve simple cleaning/polishing, welding surface depressions or cracks, mechanical straightening, precision heat straightening if the propeller alloy is suitable, and localized stress relief if required.

This habitat design has a combination of three main elements. The soft habitat bag with air locks, the shaft collars to allow attachment to various types and sizes of ship shaft/prop combinations and the main load carrying truss system. The truss and bag can be sized to suit various propeller diameters.

The current habitat design has evolved into a combination of three main elements. The bag with air locks, the shaft collars and the main load carrying truss system.

The truss may be any suitable shape which will allow the propeller to rotate in the disk-shaped area inside the truss framework. There are no limitations on truss cross-section. A flat truss, triangle truss, rectangular truss may be suitable if easy to assemble and light enough to transport.

The habitat bag will be constructed from a rubberized fabric and webbing which has been sewn and vulcanized or glued at all seams or sewn penetration points.

The shape of the habitat bag will be very similar to a bread loaf. The material will be made from multiple weights of fabric and various sizes of webbing. The bag will be capable of being reduced in size by using "D" ring tension attach points located further up on the bag perimeter. Bag size will be determined before deployment. Excess bag material will be rolled up and secured to the outer bag envelope. "D" ring tension attach points on the inside of the bag enclosure will then become the primary habitat attach points for smaller volume habitats.

Metallurgical and Nondestructive test methods will be used inside of the propeller habitat. The additional advantage is that the propeller is mounted in its working environment. This will allow detailed rotational pitch and diameter inspection not usually available in a shop environment. The customer inspector, ABS inspector or ship owner can witness the inspections if desired. Since access to the inspection area is from the top of the habitat by air lock there will be no need for diving during the inspection process. A simple face mask and emergency air pack can be carried by members of the inspection team or repair personnel.

Visual inspections can be as detailed as is required by time and service requirements. This can be as simple as numbering the propeller blades and making a video of each blade which the inspector/customer can view on the surface as the blade inspection is performed or the inspection can be recorded and viewed later.

When ship propellers are damaged in service there is usually more than one possible fix. Definition of the blade shape can be easily performed in an air habitat environment. This shape definition can use pitch gages or X, Y, Z position recording devices, such as a 3-D digitizing arm.

Surface contour and pitch gage information may be obtained and compared to the original blade requirement. If this information is not available then comparisons may be made between damaged and slightly less or undamaged blades. Repair decisions may be made on exact blade condition.

A device called a digitizing arm is available which can be employed to record surface contour. The generated digital data can then be down loaded to a personal computer (PC). The digital information from the recording of each propeller blade is then used to generate a surface contour map of each blade. A commercial CAD (computer aided drafting) program is used to generate a surface map. Both the pressure and suction sides of each blade are accessible in the habitat. Since the propeller is mounted on the actual working shaft its true working pitch, rake and skew could be recorded. Propeller repair data can be generated which will meet or exceed requirement as detailed in the "Technical Manual Marine Propeller Inspection, Repair, and Certification", document number: NAVSEA S9245-AR-TSM-010/PROP, 0910-LP-000-5260.

Conventional methods of nondestructive testing can be performed. Typical methods are Dye Penetrant (PT), Radiography (X-Ray) RT, or Ultrasonic (UT). Most marine propeller alloys will allow one or more of these methods to be used.

It is assumed that this habitat device will be employed where some propeller service problem has surfaced. This may be a noticeable increase in vibration or suspected damage from contact with debris or the bottom. It may be from fouling with the attendant hydrodynamic out of balance. Whatever the initial reason the habitat will enable rapid accurate inspection and/or repair decisions. Emergency major repair will not generally provide a propeller to like-new condition but will enable the ship to continue in service until a convenient haul-out time and dry dock are available.

Cleaning and polishing of a propeller can be easily performed in a shop type environment. Each blade can be rotated to a position for the most efficient work. A handling jib will be used inside the habitat. Any conventional cleaning and polishing process can be employed. Final wet polishing can be easily performed. Any metal debris can be captured to eliminate environmental concerns.

Since all work is performed in an air environment welding may be performed as a routine repair method. Cutting or cropping of blade tips will be simple with abundant water for cooling.

Standard industry mechanical straightening can be applied. Standard methods using clamps with air, hydraulics or ram dies can be performed.

Some propeller blade alloys will respond to heat straightening with little or no damage to the base alloy metallurgy.

On blades which may have required extensive mechanical straightening, crack repair welding or extensive heat straightening it is standard shop practice to stress relieve the damaged blade. The use of a habitat will allow thermal stress relief using resistance strip heaters with thermal blanket covers. Thermal stress relief after blade weld repair or heat straightening will be monitored using standard thermal couples.

It will also be possible to weld a replacement piece of material onto a cropped propeller blade and machine it to shape while the prop is still attached to the ship.

OBJECTS AND ADVANTAGES

To provide a shirt-sleeve work environment for precision inspection of a ship's propeller, while the ship is in the water and part of the propeller is in the water, without removal of the propeller or the dry docking of the ship;

To provide a habitat for precision repair of a ship's propeller, while the ship is in the water and part of the propeller is in the water, using methods generally applicable to a dry work environment such as a dry dock;

To provide a habitat and a work area whereby the propeller can be turned to a desired position in the habitat;

To provide a suitable work environment for propeller shaft oil seal replacement while the ship is in the water;

To provide a habitat having a work chamber for inspecting and repairing a propeller and which work chamber is composed of easily managed components for shipping, handling, assemble and disassemble operations;

To provide a shirt-sleeve work environment accessible by air lock, and which can be entered in a dry manner or by a shallow dive into the water and entering the habitat from an underneath position;

To provide a habitat and a method for inspecting and repairing the propeller of a ship while the ship is in the water and is not in dry dock;

To provide a habitat and a method for a less prolonged period of inspection and repair of a ship's propeller as the inspection and repair can be performed while the ship is in the water and the propeller is in the water and it is not necessary to place the ship in dry dock;

To provide a habitat and a method for inspecting and repairing the propeller of a ship while the ship is at sea or away from port and need not be in port to have inspection and repair;

To provide a habitat and a method for nondestructive tests of the propeller on the ship and while the ship is in the water;

To provide a habitat which is readily accessible by diving and non-diving personnel;

To provide the interchangability of shaft collars in cooperation with the truss at desired attach points;

To provide a habitat which can be readily assembled from component parts to form a truss and also can be readily disassembled;

To provide a habitat comprising subassemblies of such a size and weight that the subassembly can be transported in a pick-up truck such as a three quarter ton pick-up truck;

To provide a habitat which comprises a flexible inflatable bag which is impervious to water and impervious to air so that personnel can work in a dry environment while inspecting and repairing a ship's propeller while the ship is in the water and not in dry dock;

To provide a habitat and a method for inspecting a ship's propeller while the ship is at sea or in the water and not in dry dock;

To make it possible to have a video recordation, in a dry environment, while the ship is in the water and part of the propeller blades are in the water;

To provide a habitat for having a dry work area while the ship is in the water so that minor surface conditions can be repaired by all conventional shop processes normally performed in a dry work environment;

To provide a habitat making it possible to repair a propeller and which repair involves simple cleaning/polishing, welding surface depressions or cracks, mechanical straightening, precision heat straightening, localized stress relief, and precision contour machining;

To provide a habitat having a dry work area while the ship is in the water so that a digitizer can be used to test the blade of a propeller and from the test data determine the condition of the propeller blade and also if the propeller blade needs to be repaired;

To take advantage of the fact that the propeller is mounted in its working environment which is not possible in a repair shop environment; and, To provide machining of the propeller without removing it from the ship.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

DESCRIPTION OF THE PREFERRED EMBODIMENT(S)

A preferred embodiment comprises a truss; an inflatable air bag; and, shaft collars for fitting with the propeller shaft.

The habitat 30 comprises the truss 32, the air bag 34 and the shaft collars 36.

1. Truss

Figure 15:
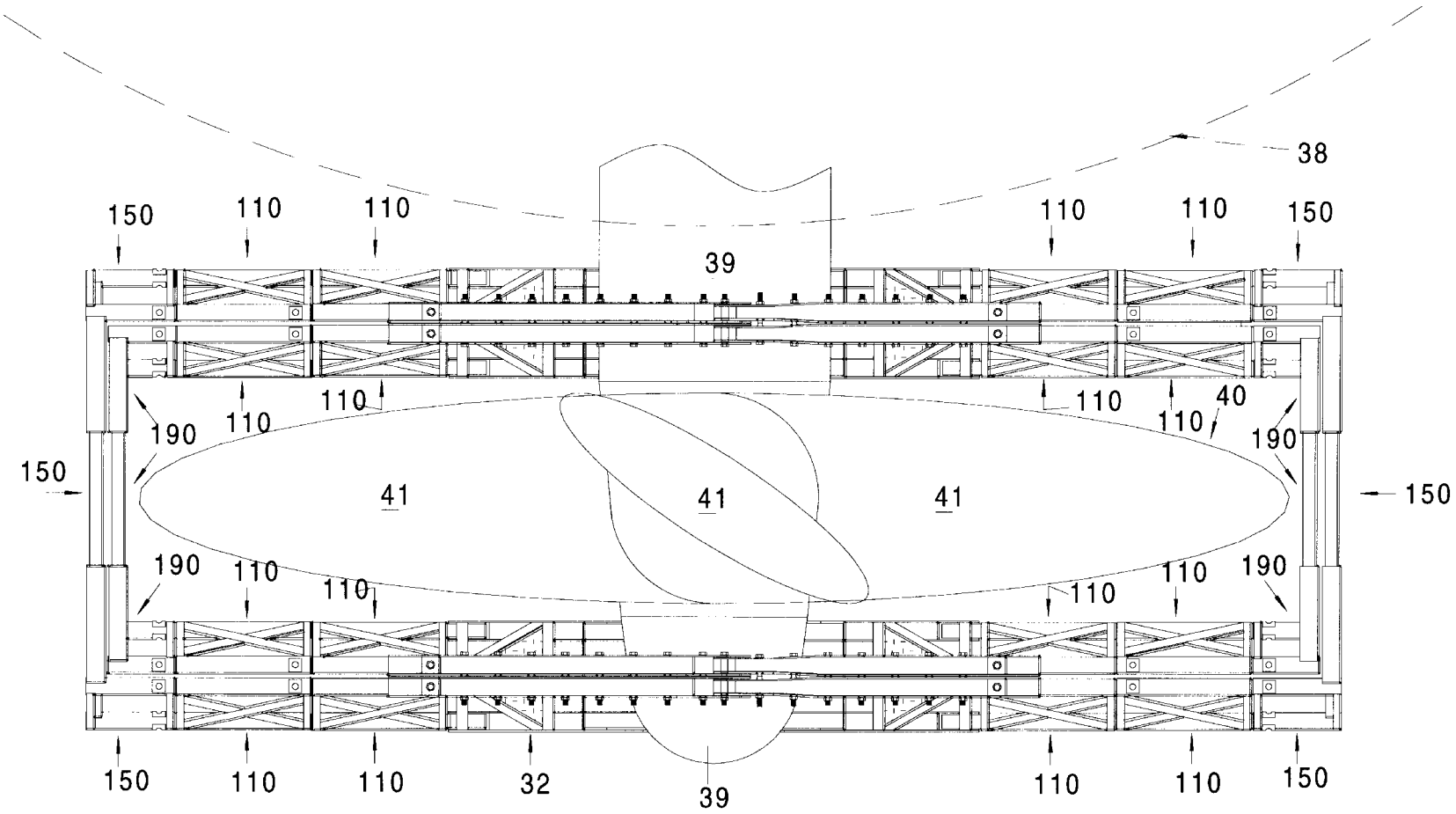
FIG. 15 is a plan view of the truss encircling the propeller and being positioned on the propeller shaft and illustrating a part of the propeller shaft.

FIG. 15 is plan view illustrating the truss 32, encompassing part of the propeller shaft 39 on a ship 38 (in phantom line). On the propeller shaft 39 there is a propeller 40 having propeller blades 41.

The truss 32 is positioned so as to be partly forward of the propeller 40 and also partly after aft of the propeller 40. In other words, the truss 32 encompasses the propeller 40 and the shaft 39. This is illustrated in FIG. 15.

The truss 32 is assembled from component parts. A propeller 40 may have a diameter of 12 feet and may range in diameter to 30 feet. With the component parts of the truss 32, it is possible to prepare a truss of any reasonable length. For example, if necessary from the component parts the truss 32 can be made for a propeller 30 feet in diameter. At another time the component parts can be assembled to have a truss for encompassing a propeller of 12 feet.

2. "C" Sections

For fitting around and encompassing the propeller shaft 39, there are "C" sections.

Figure 14:
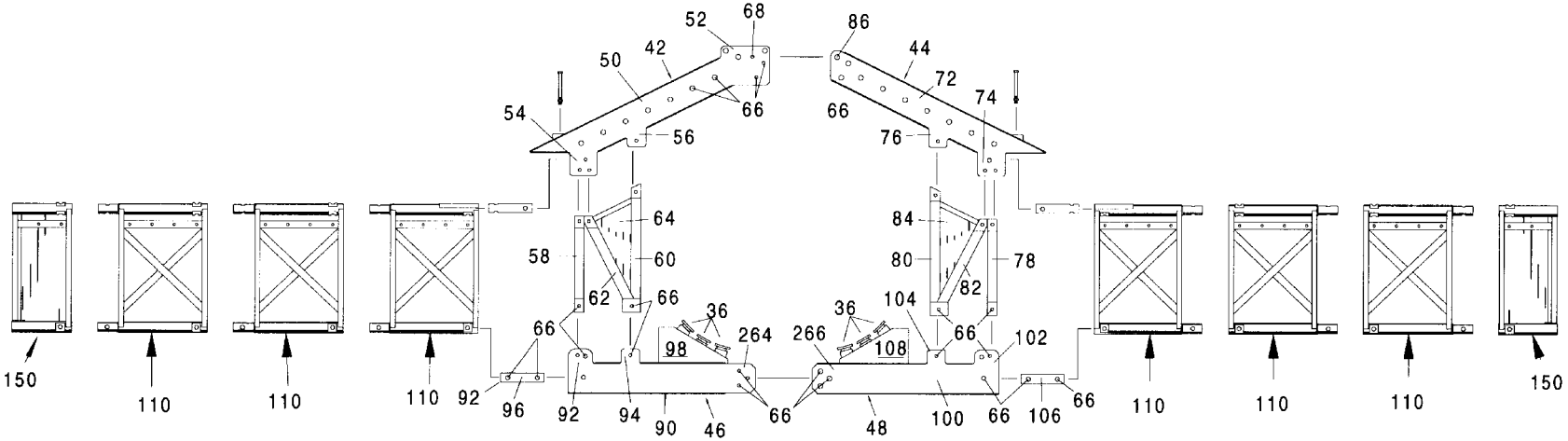
FIG. 14 is an exploded view of the truss showing individual sections.

With reference to FIG. 14 there is a top "C" section 42 for receiving a top "C" section 44. Also, there is a bottom "C" section 46 for receiving a bottom "C" section 48. The "C" sections 42, 44, 46 and 48 are assembled around the propeller shaft 39. In fact, one set is assembled forwardly of the propeller blades 41 and another set is assembled rearwardly of the propeller blades 41.

a) Top "C" Section 42

With respect to FIGS. 1, 3, 4, 5, 14, 15, it is seen that there is a brace 50 having an enlarged upper end 52. Also, there is a lower connecting area 54 and a middle connecting area 56. There is a short arm 58, a long arm 60 and a diagonal brace 62. Further, there is a reinforcing plate 64 connecting with 62 and 60. There are a number of holes or passageways 66 for receiving bolts or pins. Further, in the enlarged upper end there is a pivot point 68. 68 is a hole for receiving a tapered pin or a bolt.

The members 58, 62, 60 can be attached to the brace 50. The holes on the upper ends of 58 and 62 can be attached to the lower connecting area 54 by means of bolts or tapered pins in the holes or passageways 66. The long arm 60 can be attached to the middle connecting area 56 by means of a bolt or a tapered pin through the holes 66 in 56 and also in 60.

b) Top "C" Section 44

The top "C" section 44 comprises a brace 72 having a lower connecting area 74 and a middle connecting area 76. There are holes 66 in 74 and 76 as well in 72. There is a short arm 78 having holes 66 at each of its ends. There is long arm 80 having holes 66 at each of its ends. There is a diagonal brace 82 connecting with a lower part of the long arm 80. The diagonal brace has a hole 66 at its upper end. There is a reinforcing plate 84 connecting with 80 and 82. In the upper part of the brace 72 there is a hole 86 which can be considered to be a pivot point or a pivot area. In assembling the "C" sections 42 and 44 a bolt or a tapered pin can be positioned in the hole 68 in the upper part of the brace 50 and also in the hole 86 in the upper part of the brace 72. In fact, the brace 50 and the brace 72 can rotate around the pin or bolt in the holes 68 and 86. The upper part of the long arm 80 can be attached to the middle connecting area by means of a tapered pin or bolt in the hole 66 in each of these members. Likewise, the long arm 80 and the diagonal brace 82 can be attached to lower area 74 by means of bolts and/or tapered pins in the hole 66 in the upper part of 82 and 78 and in the lower connecting area 74.

Figure 4A:
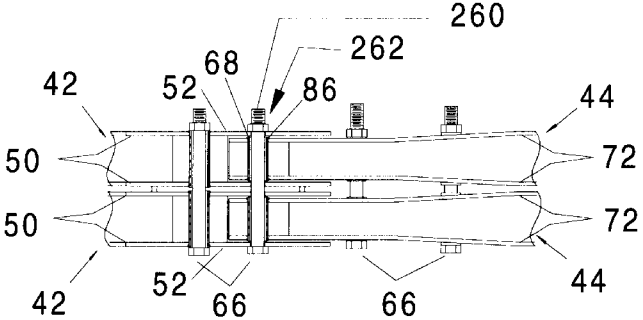
FIG. 4A is a cross-sectional view taken on line A—A of FIG. 4 and illustrates the connection of the left top "C" section with the right top "C" section.

In FIG. 4A it is seen that there are fragmentary portions of the top "C" sections. There are two such "C" sections adjacent to each other. The section 42 comprises two spaced-apart braces 50. There is inserted between these two braces 50 the two braces 72 of section 44. In each of the braces 50 there is a hole or passageway 68. In each of the braces 72 there is a hole or passageway 86. 68 and 86 are aligned and a bolt 260 is positioned in these holes or passageways. Then, a nut 262 can be placed on the bolt 260. The bolt 260 is a pivot pin around which the top "C" section 42 and the top "C" section 44 can rotate. In certain instances, the sections 42 and 44 are rotated around the bolt 260. In FIG. 4A it is seen that there are two such sets of sections 42 and 44 for rotation and/or joining by the bolt 260.

c) Lower "C" Section 46

There is a bottom "C" section 46 comprising a brace 90 having an outer end connecting area 92 and a middle connecting area 94. 92 and 94 have holes 66. Also, there is a connecting rod 96, in FIG. 14, directed leftwardly. This connecting rod has a hole 66. Connecting rod 66 is distinct and separate from "C" section 46. Near the inner end of the brace 90 it is seen that there is a spacing block 98. There is positioned on the spacing block 98 the shaft collars 36 for bearing against the propeller shaft 39.

d) Lower "C" Section 48

In FIG. 14 it is seen that there is a lower "C" section 48. This section comprises a brace 100 having an outer end connecting area 102 with holes 66 and a middle connecting area 104 with hole 66. On the inner end of the brace 100 there are holes 66. Also, on the right side of the brace 100 there is a receiving area for a connecting rod 106 having a hole 66. Further, there is on the upper part of the brace 100 and near the inner end a spacing block 108. Shaft collars 36 are positioned on the spacing block 108.

The brace 90 can be connected to the lower end of the short arm 58, the diagonal bracket 62 and the long arm 60. The lower end of the short arm 58 can be connected to the outer end connecting area 92 by a bolt or a tapered pin in the holes 66 in the members. The diagonal brace 62 and the long arm 60 join at their lower ends and can be connected to the brace 90 at the middle connecting area 94 by means of a bolt or a tapered pin in the holes 66 in these members.

Similarly, the short arm 78 can be connected to the outer end connecting area 102 on the brace 100 by means of a bolt or a tapered pin in the holes 66 in these respective members. The long arm 80 and the diagonal arm 82 connect at their lower ends and can be connected to the inner end connecting area 104 by means of a bolt or tapered pin in the holes in the respective members. The right end of the brace 90 can be connected to the left end of the brace 100 by means of bolts or tapered pins in the holes 66 in the respective members.

In FIG. 14 it is seen it is seen that to the right of the brace 100 there is a connecting rod 106 having holes 66 in each end. The hole 66 and the connecting rod 106 near the brace 100 can be aligned with a hole 66 in the outer end 102. Then a pin or a bolt can be inserted in these two holes to unite the connecting rod 106 and the brace 100. Likewise, the hole 66 and the connecting rod 106 away from the brace 100 can be aligned with a hole in the "A" section and a bolt or tapered pin placed in the holes for uniting the brace 100 in the "C" section.

Figure 4B:
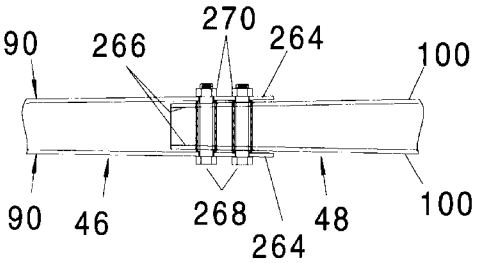
FIG. 4B, taken on line B—B of FIG. 4, is a bottom cross-sectional view illustrating the connection of a lower left "C" section with a lower right "C" section.

With reference to FIG. 4B, a fragmentary bottom plan view showing uniting of the lower "C" section 46 with a lower "C" section 48 it is seen that there are two braces 90 in the spaced-apart relationship. Further, there are two braces 100 in the spaced-apart relationship. The two braces 100 are received and fit inside of the two braces 90. The inner end of the brace 90 is referred to by reference numeral 264. The inner end of the brace 100 is referred to by reference numeral 266. In 264 and 266 there are holes or passageways 66 which are aligned. Bolts 268 are placed in these passageways or holes 66. Also, it is seen that there is a nut 270 on each of the bolts 268.

In this manner the lower "C" sections are joined.

3. "A" Sections

There are "A" sections which can be assembled to help form the truss 32. Reference is made to FIGS. 1, 3, 4, 5, 10, 11, 14 and 15.

Figure 11:
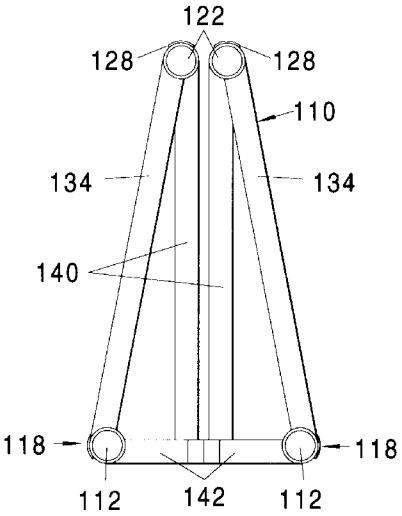
FIG. 11 is an end elevational view of the "A" section.
Figure 10:
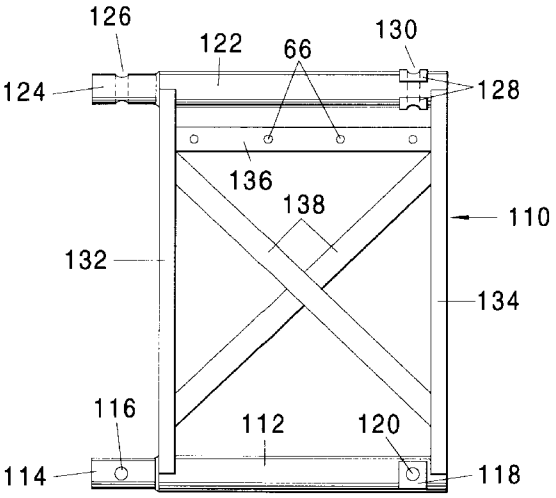
FIG. 10 is a side elevational view of an "A" section and illustrates the cross bracing, the upper tubes and the lower tubes for receiving rods or connectors for joining together adjacent "A" sections.

With reference to FIGS. 10 and 11 it is seen that there is an "A" section 110. FIG. 10 is a side elevational view and FIG. 11 is an end elevational view.

The "A" section 110 comprises a bottom support or tube 112. On the left end there is a lower left rod of a smaller outside dimension or diameter than the inner dimension or diameter of tube 112. In 114 there is a hole or passageway 116. Near the right end of the tube 112 there is a reinforcing bracket 118. There is a hole 120 in the bracket 118 and also in the tube 112. The "A" sections 110 are the same design and construction. The "A" sections are used interchangeably with each other in the assembly of the truss 32. In assembling the "A" sections 110, the rod 114 is inserted into the tube 112 of the adjacent "A" section and a bolt or tapered pin is positioned in the holes 120 and 116 to secure together the two "A" sections. The hole 120 is a horizontal hole and the hole 116 is a horizontal hole. There is an upper support or tube 122 spaced apart from 112. On the left of the tube 122 there is a upper left rod 124 having a vertical hole 126. The inner dimensions or diameter of the tube 122 are greater than the outer dimension or diameter of the upper left rod 124 so that the rod 124 can be inserted into the next adjacent tube 122 of the "A" section 110. On the right of the tube 122 there are reinforcing brackets 128. There is a hole 130 in the reinforcing brackets 128 and also in the tube 122. With the insertion of the upper left rod 124 in the next adjacent tube 122, a tapered pin or a bolt can be positioned in the holes 128 and 130 to secure together two adjacent "A" sections 110. There is an outer left vertical bracing strap 132 and an outer right vertical bracing strap 134. There is an upper connecting brace 136 connecting with 132 and 134. There are holes 66 in the strap 136. There are diagonal reinforcing braces 138 connecting with 132 and 134.

In FIG. 11 it is seen that there are inner vertical supports 140. Also, there is a lower base connector 142 connecting with the tubes 112. The inner vertical supports 140 connect with the tubes 122 and also with the tubes 112.

In FIG. 11 it is seen that there are two upper tubes 122 and two spaced-apart lower tubes 112. With the positioning of the rods 114 in the tubes 112 and the rods 124 in the tubes 122 and the use of bolts or tapered pins, the two "A" sections are securely fastened together.

Figure 12:
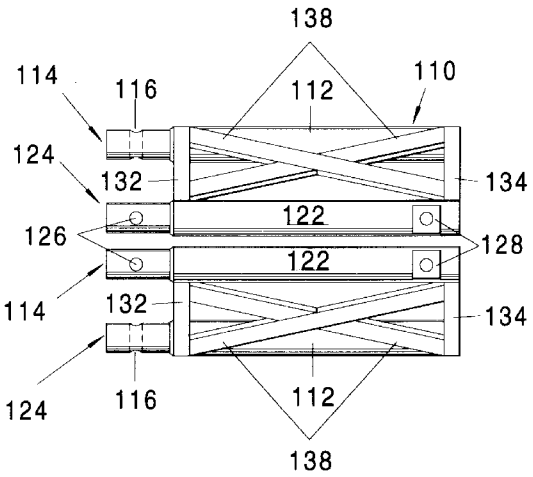
FIG. 12 is a top plan view of the "A" section.

FIG. 12 is a top plan view of the "A" section 110. This view assists in illustrating the "A" section. There is clearly presented a view of the tubes 112 and 122; the bracing straps 132 and 134 along with the brace 136; the diagonal braces 138; the vertical passageways 126 and 130; and the horizontal passageways 116 and 120.

4. End Sections

Figure 7:
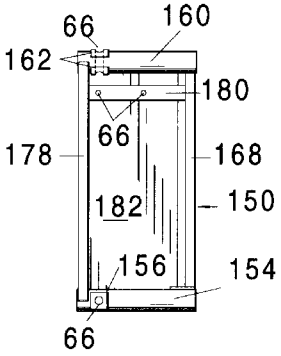
FIG. 7 is an elevational view of an outside end of the truss.
Figure 6B:
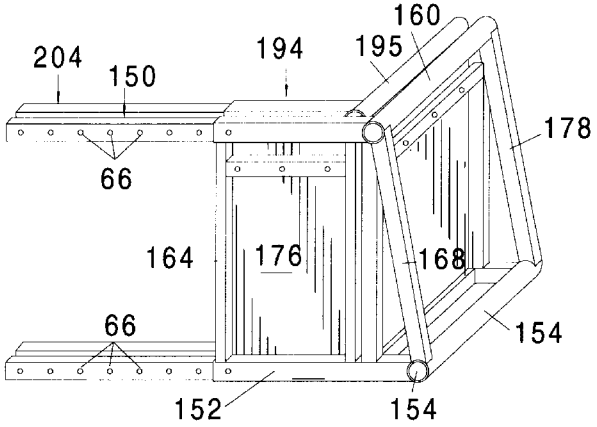
FIG. 6B is a perspective view looking at the combination of FIG. 6, the outer end section, and FIG. 7, the outside end of the truss, as combined for the outer end of the truss.
Figure 6:
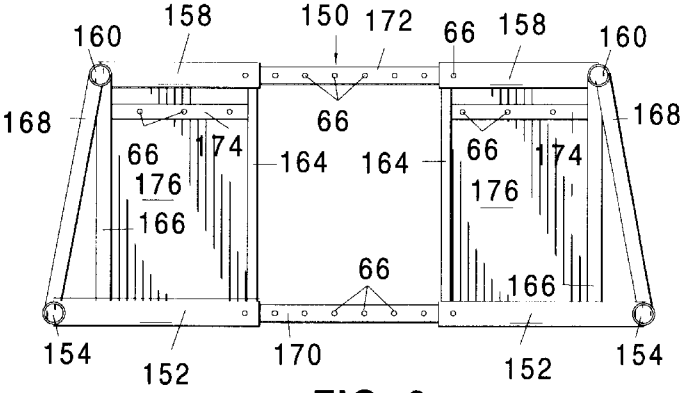
FIG. 6 is an elevational view of an outer end section and illustrates the means for varying the length of the outer end section.

An outer end section 150 is illustrated in FIGS. 6 and 7. Outer end section 150 joins the outer "A" sections of the truss 32. Reference to FIG. 15 may assist in showing the position section 150.

Section 150 comprises a lateral lower end tube 152 and a, longitudinal lower end tube 154. There is a lateral upper end tube 158 and a longitudinal upper end tube 160.

On 160 there are reinforcing plates 162. There is a hole through the tube 160 and the reinforcing plates 162 for receiving a bolt or a tapered pin. There is an inner upright support 164 and an outer upright support 166. Further, there is an outer diagonal upright support 168 connecting with 154 and 160. In the lower end tube 152 there is a hole 66. There is a lower connecting rod 170 connecting with the two spaced-apart lower end tubes 152. In 170 there are holes 66 which can be aligned with holes 66 in 152 for receiving a bolt. In this manner the length of 150 can be controlled.

a) End Section Adjustment

In FIG. 6 it is seen that there is one section to the left of the connecting rod 170 and another section to the right of the connecting rod 170. In each of the tubes 152 and near the rod 170, there is a hole 66 for receiving a bolt or a pin. In the rod 170, there are a number of spaced-apart holes 66 for receiving a bolt or a pin. The distance between the right part of the outer end section 150 and the left part can be determined by the position of the connecting rod 170 in the tubes 152. The distance between the left section and the right section of 150 is determined by the position of the rod 170 in the tubes 152 and the bolts or tapered pins in the holes 66. At the top of 150 there is a connecting rod 172 having a plurality of holes 66. Each of the upper end tubes 158 have a hole 66. The position of the rod 172 in the tubes 158 determine the spacing between the two sections of the outer end section 150. A bolt or a tapered pin can be placed in the appropriate hole 66 in 158 and in the rod 172. There is a lateral upper connecting brace 174. There is a reinforcing plate 176 connecting with upright support 164 and upright support 166. There is an inner diagonal upright support 178 connecting with the lower end tube 154, the upper end tube 160 and the longitudinal upper connecting brace 180. There are holes 66 in the longitudinal connecting brace 180.

Figure 9:
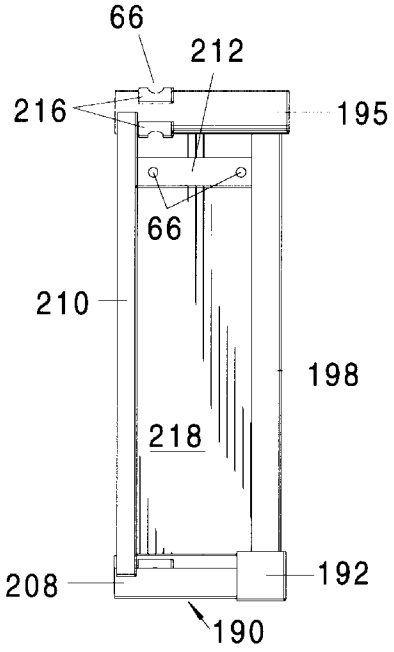
FIG. 9 is an elevational view of an inside end of the truss.
Figure 8:
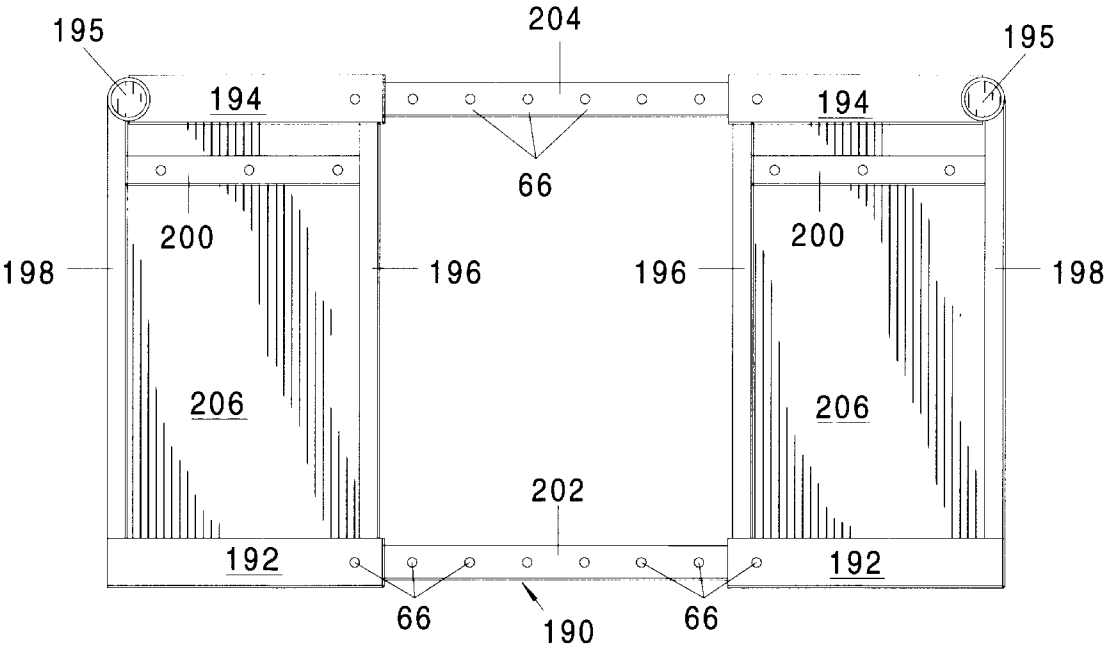
FIG. 8 is an elevational view of an inner end section and illustrates the means for varying the length of the inner end section.

In FIGS. 8 and 9 there is illustrated an inner end section 190. The section 190 comprises a left part and a right part which are separated. The left part and the right part each comprise a lateral lower end tube 192 and a lateral upper end tube 194. Each part comprises an upper longitudinal tube 195. There is an outer upright support 198. There is and inner upright support 196. There is a lateral brace 200 connecting with 196 and 198. There is a lower connecting rod 202 having a plurality of holes 66. The tube 192 at that end near the rod 202 has a hole 66. There is a reinforcing plate 206 connecting with 192, 196, 198 and 200. In FIG. 9 it is seen that there is a lower longitudinal tube 208 and an inner upright brace 210. There is an upper longitudinal brace 212 connecting with 198 and 210. On the tube 195 there are two reinforcing brackets 216. There is a hole or passageway 66 through the brackets 216 and also through the tube 195 for receiving a bolt or a tapered pin. There is a reinforcing plate 218 connecting with 198, 210 and 212.

A comparison of FIGS. 6 and 8 shows that the outer end section 150 is longer than the inner end section 190. This is pictorially illustrated in FIG. 15. It is seen in FIG. 15 that 190 connects with the inner "A" sections and that 150 connects with the outer "A" sections. The inner "A" sections are closer to the propeller blades than the outer "A" sections. Again, the distance between the two inner "A" sections, one forwardly of the propeller blades 41 and one rearwardly of the propeller blades 41, can be adjusted for the spacing by means of the rod 202 in the tubes 192 and the rod 204 in the tubes 194. Bolts or tapered pins can be placed in the appropriate holes or passageways 66 in the rod 190 and in the tubes 192 and likewise the bolts or tapered pins can be placed in the holes 66 and the rod 204 and the appropriate holes in the tubes 194. In other words, the spacing between the inner "A" sections 110 can be determined by the inner end section 190 and the outer end section 150.

5. Adjustment for Propeller Diameter

By selecting the appropriate number of "A" sections 110, the habitat 30 can be adjusted for accommodating propellers having a diameter from 12 feet to 30 feet. An adjustment for the width of the propellers can be achieved by positioning rod 170 in tubes 152 and rod 172 in tubes 158 for the outer end section 150; and, also by adjusting the position of the rod 202 in the tubes 192 and the rod 204 in the tubes 194.

It is to be understood that the "A" sections can be connected together by bolts and nuts in the appropriate holes 66 or by tapered pins. Also, the end sections 150 and 190 can be attached to the "A" sections 110 by means of appropriate bolts and tapered pins.

Figure 13:
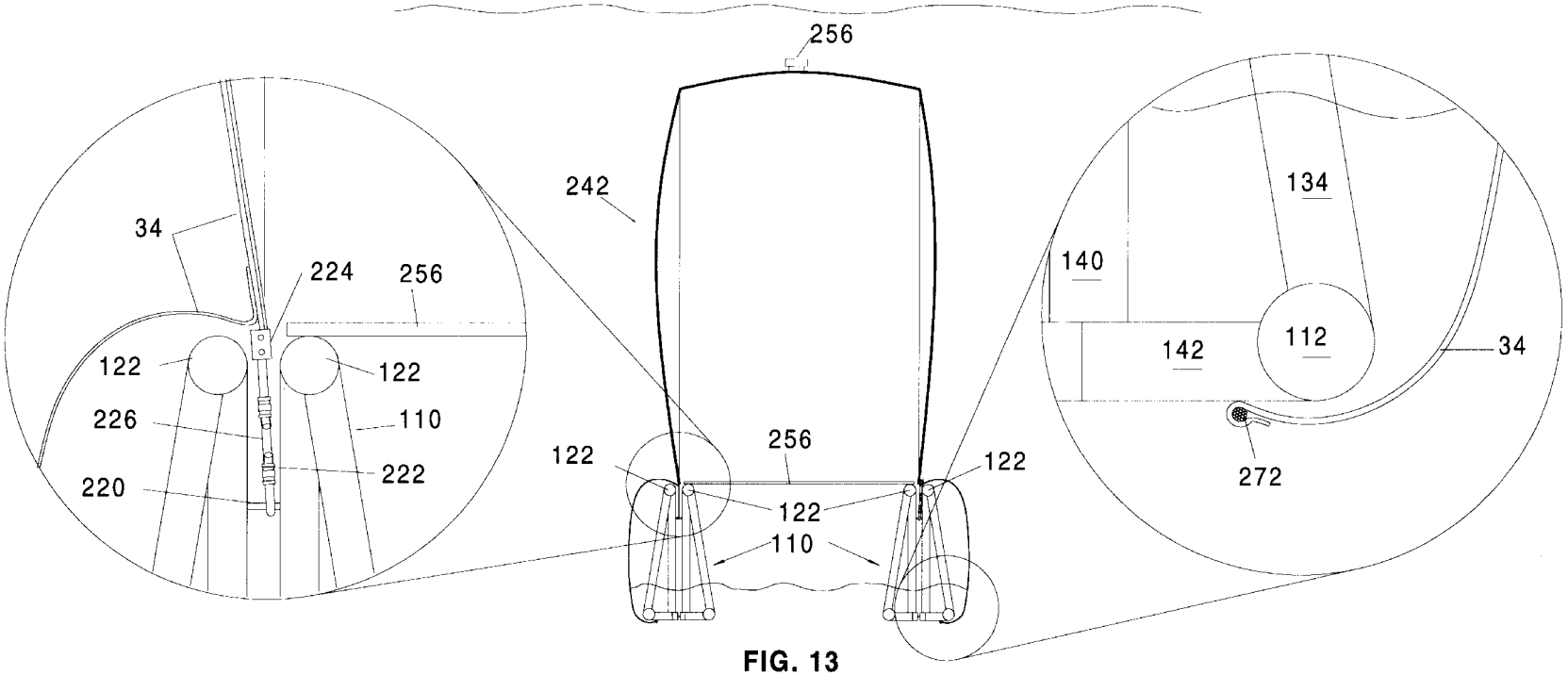
FIG. 13 is an elevational view illustrating the "A" section, the means to assist in moving the "A" section, the inflatable bag and the attachment of the inflatable bag to the "A" section with an enlargement of the upper part of the "A" section and the habitat bag being attached to the bag above the "A" section and looping downwardly and outside of the "A" section and on the right an enlarged view illustrating the attachment of the habitat bag underneath the "A" section.

With reference to FIGS. 10 and 13 it is seen that a bolt or a pin can be positioned in holes or passageways 66 in 136 on each part of the "A" section. Then, a clevis 222 can be positioned around the bolt or pin 220. A hook 224 is connected to the clevis 222. The hook 224 is connected to a lifting cable 226 from a crane or the like. The "A" section 110 can be lifted or moved to a desired location. The desired location can be underwater and near the propeller shaft 39 and near the propeller blades 41.

6. Truss Bag

Figure 1:
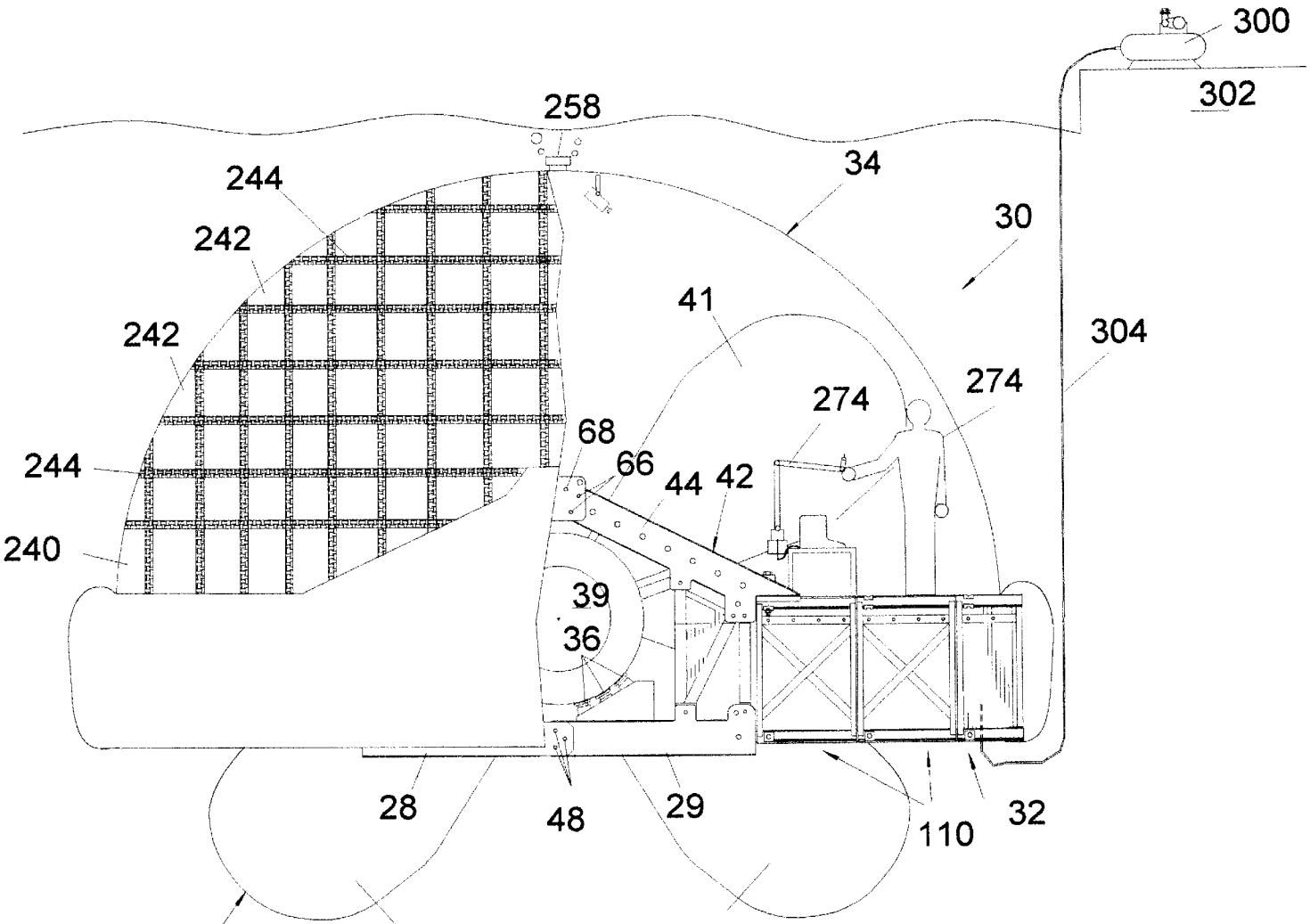
FIG. 1 is a fragmentary end elevational view illustrating the ship's propeller shaft, the propeller, the habitat encompassing the upper part of the propeller and the propeller shaft and comprising a truss, an inflatable bag attached to the truss, and with part of the bag broken away to illustrate the outline of a person standing on the truss catwalks and inside the bag to illustrate the size of the truss and the size of the bag and with said person employing a test instrument on a propeller blade.
Figure 2:
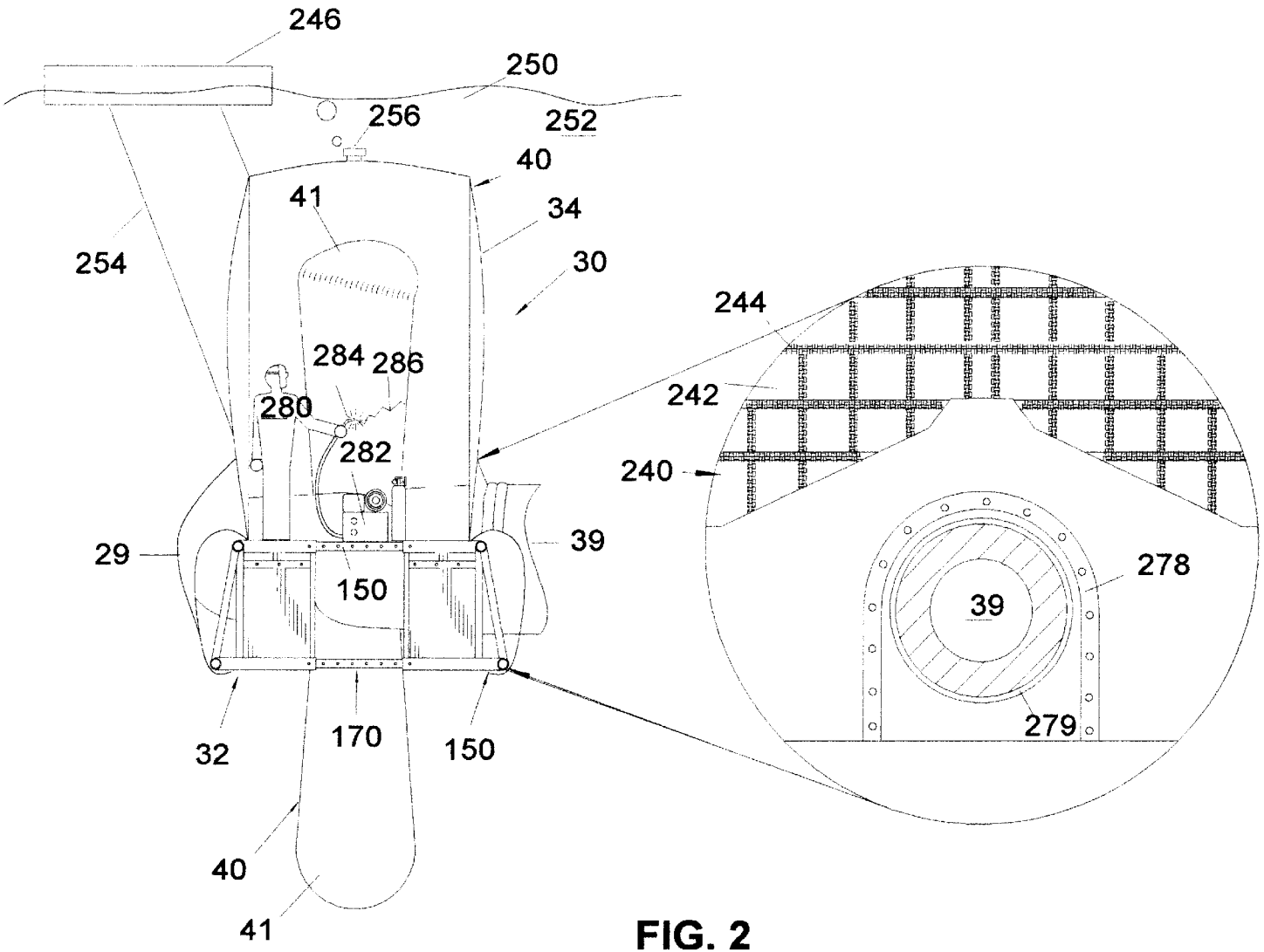
FIG. 2 is a fragmentary side elevational view illustrating the propeller shaft, the propeller, the truss, the inflatable bag, an air lock connecting with the inflatable bag for entry from the surface of the water and into the habitat, and also illustrating two people standing on the truss catwalks and inside the inflatable bag to illustrate the size of the habitat and the propeller and also with one person holding a welding torch for repairing a propeller blade, and in an enlarged detail illustrates the attaching of the habitat bag around the propeller shaft.

With reference to FIGS. 1, 2 and 13 it is seen that there is an inflatable, expandable bag 240. The bag is composed of a rubberized, rip stop fabric 242. There are reinforcing straps 244 on the outside of the fabric 242. The reinforcing straps 244 assist and maintain the configuration of the rubberized fabric when the bag 240 is inflated with air.

Should a leak develop in a panel of fabric, the straps stop the tear and rapid loss of air from the bag.

a) Bag Access Methods

In FIG. 2 it is seen that there is an air lock 246 floating on the surface of 250 of the water 252. There is a tube 254 connecting the air lock 246 and with the air bag or habitat bag 240. This makes it possible for a person to enter the air bag 240 without having to dive into the water. This is one way of entering the habitat 30. Another way of entering the habitat 30 is to have the proper diving equipment and to dive into the water and dive below the truss 32 and then emerge between the "A" sections 110 and the propeller blades 41. One method is a dry method through the air lock 246, and the other method is a wet method diving into the water using submersible either with scuba or hard hat diving equipment.

FIGS. 1, 2 and 15 illustrate a truss assembled around propeller shaft 39, propeller 40 and propeller blades 41.

7. Habitat Assembly

There are a number of methods of assembling the truss 32.

a) Assembly Method One

Figure 4:
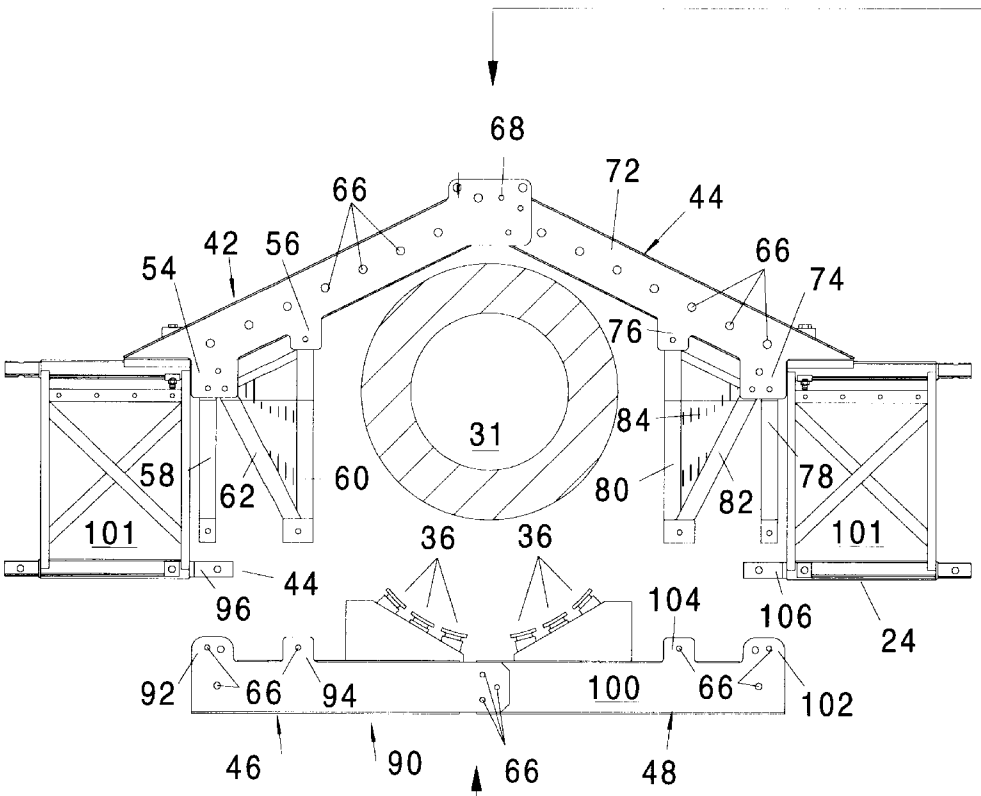
FIG. 4 is an end elevational view of the central part of the truss illustrating the upper "C" sections and the lower "C" sections separated, and the propeller shaft.

One method, with reference to FIG. 4, is on the deck of the ship to assemble the top "C" section 42 and the top "C" section 44 by bolts or tapered pins at holes 66 in the enlarged upper end 52 of 42 and the upper end of brace 72. The bolts or tapered pins can be positioned in the holes 66 in these members. The two "C" sections 42 and 44 are rigidly joined. Also, a bolt or a tapered pin can be positioned in pivot point holes 68 and 86 and in pivot point hole 86 in 72. In FIG. 4 there is a bolt 260 in holes 68 and 86 as explained with reference to FIG. 4A. With reference to FIG. 15, the reader is to understand that there are four top "C" sections 42 and four top "C" sections 44 which are to be joined in the formation of the truss 32.

Then, the assembled "C" sections can be lowered so that two of these sections are forwardly of the propeller 40 and two of the sections are rearwardly of the propeller 40. These "C" sections are resting on the propeller shaft 39.

Then, the bottom "C" section 46 and the bottom "C" section 48 can be joined by a bolt or a tapered pin in holes and passageways 66 in the brace 90 and in the brace 100. This joining of these "C" sections can be performed on the deck of the ship 38. Reference is made to FIG. 4B and the explanation of FIG. 4B. Then, the four connected bottom "C" sections can be lowered into the water by a crane and cable so as to be underneath the propeller shaft 39 and the propeller blades 41. Then, these four "C" sections can be raised so as to be in contact with the underneath part of the propeller shaft 39.

Then, the holes 66 in the outer end connecting area 92 of brace 90 can be joined with the hole 66 in the lower end of the short arm 58 by a bolt or a tapered pin. Similarly, the hole 66 in the middle connecting area 94 of brace 90 can be joined to the holes 66 in the lower end of the long arm 60 by a bolt or tapered pin. Likewise, the hole 66 in the inner end connecting of 104 can be joined to the holes 66 in the lower end of the long arm 80 by means of a bolt or tapered pin. Similarly, the hole 66 in the outer end connecting area 102 can be joined to the hole 66 in the lower end of the short arm 78 by a bolt or tapered pin. At this stage the "C" sections have been positioned around propeller shaft 39 and are in contact with the propeller shaft 39 by means of shaft collars 36. Then, the "A" sections 110 can be joined to the "C" sections to extend the truss outwardly beyond the diameter of the propeller blades 41.

At the appropriate distance on the assembly of the truss the inner end sections 190 can be joined to the appropriate "A" sections. Likewise, the outer end sections 150 can be joined to the "A" sections 110 to complete the truss. This is illustrated in FIG. 15. The joining of the "C" sections with the "A" sections 110, the inner end sections 190 and the outer end sections 150 is done by divers in the water. These divers can descend from the ship and work under the surface of the water to assemble the truss 32 adjacent to the propeller 40 and the propeller shaft 39.

b) Assembly Method Two

Figure 3A:
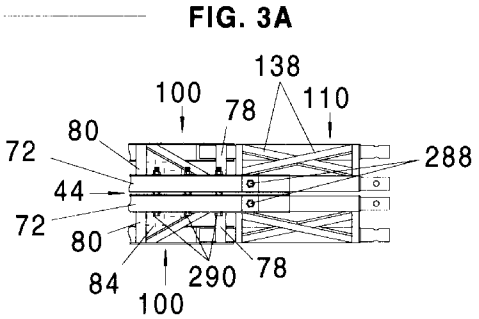
FIG. 3A, taken on line A—A of FIG. 3, is a fragmentary top plan view illustrating the connection of the top right "C" section and the junction with the "A" section.
Figure 3B:
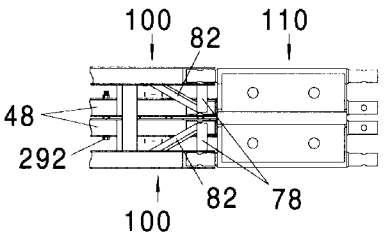
FIG. 3B is a bottom plan elevational view, taken on line B—B of FIG. 3, illustrating the connection of the right bottom "C" section with the lower part of the "A" section.
Figure 3:
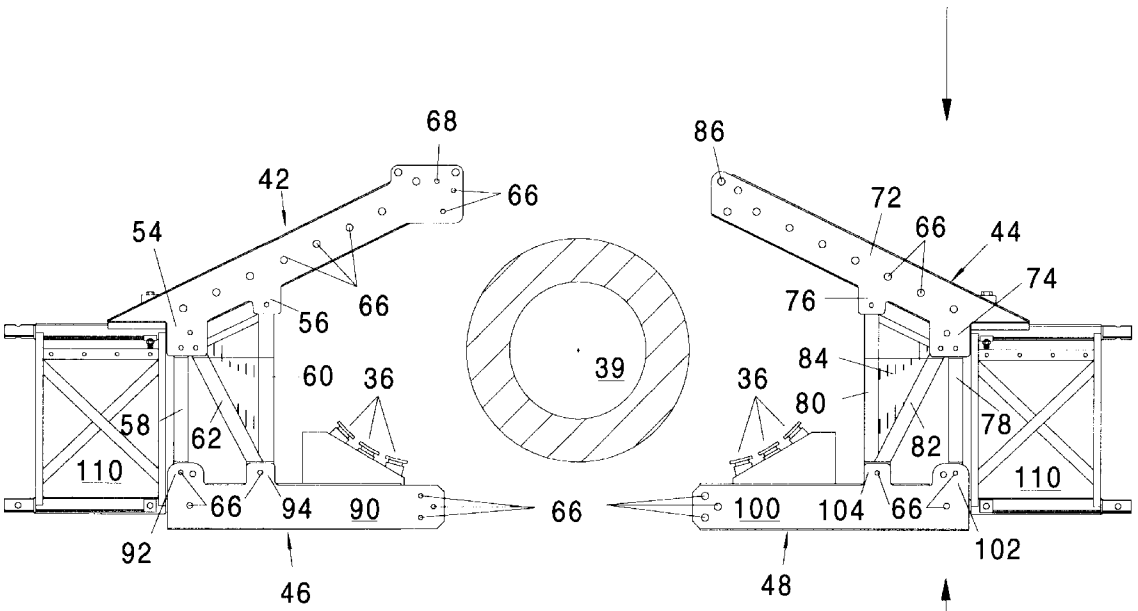
FIG. 3 is a fragmentary end elevational view of a partially exploded central part of the truss illustrating the top "C" sections, the bottom "C" sections and the propeller shaft.

A second method for assembling the truss 32 is illustrated in FIG. 3.

The top "C" section 42 and the bottom "C" section 46 are joined on the deck of the ship by placing bolts and tapered pins in the appropriate holes or passageways 66. Likewise, the upper "C" section 44 and the bottom "C" section 48 are formed on the deck of the ship 38. Bolts or tapered pins are positioned in the appropriate holes or passageways 66 to assemble these two "C" sections. Then, a crane or cranes with cables can be used for lowering each of these sections to be close to the propeller shaft 39. Divers can maneuver these sections around the propeller shaft and around the propeller blades 41. Bolts or tapered pins can be positioned in the holes 66 in the enlarged upper end 52 and in the hole 66 in the upper end of the brace 72. Also, bolts can be positioned in the appropriate holes or passageways 66 in the right end of the brace 90 and in the left end of the brace 100. This unites these "C" sections around the propeller shaft 39. Further, a bolt or a tapered pin can be positioned in the pivot point holes 68 and the pivot point hole 86.

The shaft collars 36 are bearing against the propeller shaft 39.

The "A" sections 110, the inner end section 190 and the outer end section 150 can be assembled by divers underneath the surface of the water by placing bolts and/or tapered pins in the appropriate holes in these sections so as to join together the sections and make the truss 32.

Again, it is to be understood that there are four sets of "A" sections 110 and two sets of inner end section 190 and outer end section 150. The divers can assemble these sections underneath the surface of the water.

c) Assembly Method Three

Figure 5:
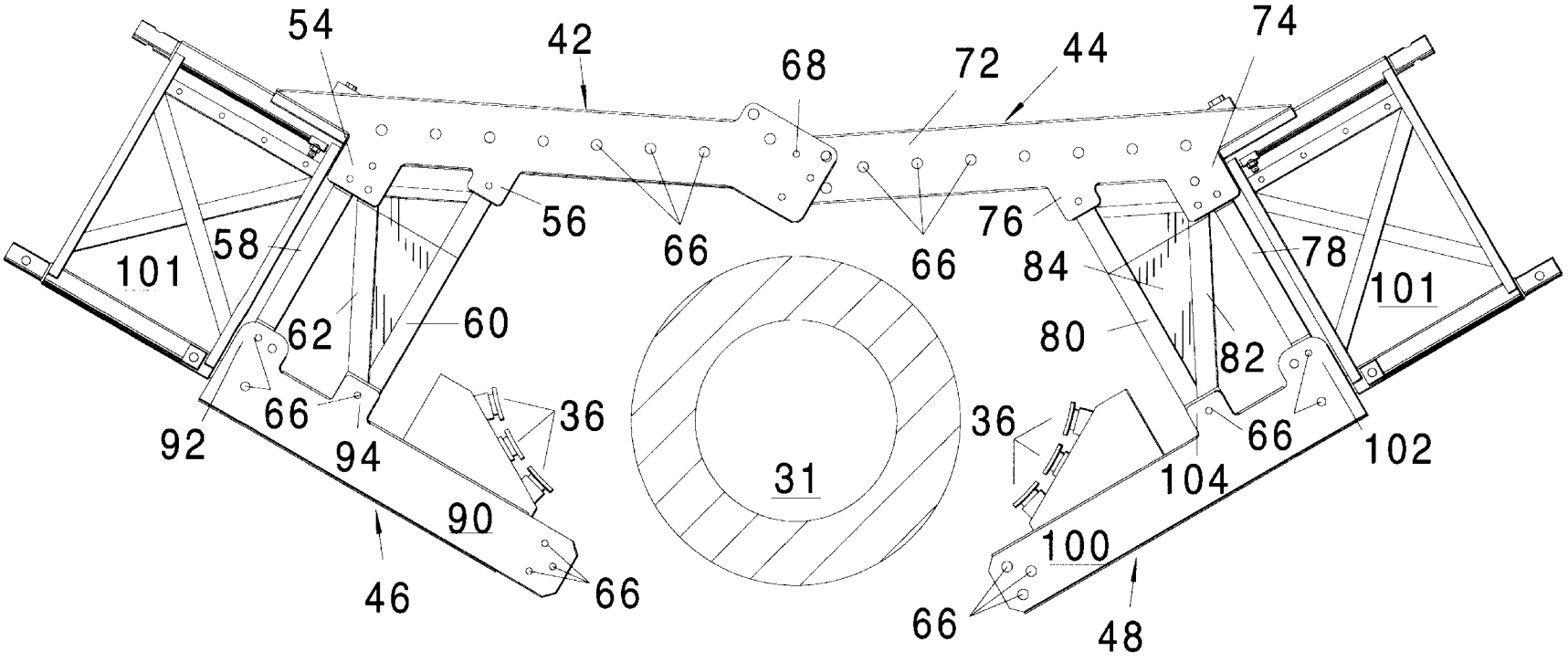
FIG. 5 is an end elevational view of the central part of the truss with the upper "C" sections connected and juxtapositioned to the propeller shaft, and with the lower "C" sections in a separated position.

A third method for assembling the truss 32 is illustrated in FIG. 5.

The components of the truss 32 can be assembled on the deck of the ship 38. There is one bolt 260 in the pivot point hole 68 in the enlarged upper end 52 of the upper "C" section 42 and in the pivot point hole or passageway 86 in the brace 72 of the upper "C" section 44. In FIG. 5 it is seen that the truss is pivoted around the bolt 260 in the two passageways 68 and 86. In FIG. 5 it is seen that the left side of the truss is elevated and also that the right side of the truss is elevated. The truss in this condition or state can be lowered around the propeller shaft 39 and around the propeller blades 41. Then, the left side of the truss 32 and the right side of the truss can be rotated so that the passageways 66 in the brace 90 and the passageways 66 in the brace 100 are aligned. Then, bolts or pins can be placed in these passageways so as to rigidly join the two "C" sections 42 and 44. Likewise, the passageways 66 in the enlarged upper end 52 and in the brace 72 are aligned and bolts or pins can be placed in these passageways so as to have an assembled truss 32.

Again, reference is made to FIG. 15, a plan view, illustrating the truss 32 around the propeller shaft 39 and the propeller blades 41.

d) Assembly Method Four

A fourth way for assembling the truss 32 around the propeller shaft 39 and the propeller 40 is illustrated in FIG. 5. The top "C" sections 42 and 44 are joined by bolts or tapered pins and holes 66, 68 and 86 in these "C" sections. The "A" sections are not joined to these top "C" sections. With respect to FIG. 5 the "A" sections 110 are not joined to the top "C" sections 42 and 44. These two sections can be lowered by a crane and cable or chain to fit over the propeller shaft 39 and to be positioned on the propeller shaft 39.

The bottom "C" sections 46 and 48 are joined by bolts or pins in the holes 66 of these sections as illustrated in the lower part of FIG. 5. Then, a crane and a cable or chain can be used to lower these two joined sections 46 and 48 and raised so that the shaft collars 46 are bearing against the propeller shaft 39. Then, the short arm 58 can be joined to the outer end connecting area 92 by means of bolts or tapered pins in the holes 66. And, lower ends of the diagonal brace 62 and the long arm 64 can be joined to the middle connecting area 94 by bolts and tapered pins in the holes 66. Likewise, lower ends of the long arm 80 and the diagonal brace 82 can be joined to the inner end connecting are 104 by means of bolts and tapered pins in the holes 66. Also, the lower end of the arm 78 can be joined to the outer end connecting area 102 by bolts and/or tapered pins in the appropriate holes 66. This positions the lower "C" sections 46 and 48 and the upper "C" sections 42 and 44 around the propeller shaft 39. The rest of the truss can be assemble under water. The "A" sections can be added to the "C" sections by joining the appropriate sections together by bolts and/or tapered pins. The length of the truss 32 can be varied by the use of the number of "A" sections 110. For a 30-foot propeller there will be a large number of "A" sections 110. For a 12-foot propeller there will be only a few "A" sections 110. This is one of the advantages of the truss 32. It can be assembled to the appropriate size for the propeller to be inspected and/or repaired.

With the appropriate number of "A" sections 110 in position, then the inner end sections 190 and the outer end sections 150 can be assembled in place by bolts and/or tapered pins.

e) Assembly Method Five

A fifth method of assembling the truss 32 is by lowering pieces or sections of the truss below the surface of the water and adjacent to the propeller shaft 39 and the propeller 40. The divers can assemble the truss piece-by-piece or section-by-section.

8. Bag Deployment

After the truss 32 is assembled and positioned with respect to the propeller shaft 39 and the propeller 40, the air bag 34 is lowered over the propeller 40 and unfolded into position. The reinforcing straps 244 are attached to the "A" sections 110 as illustrated in FIG. 13, and the air bag 34 is pulled down on the outside of the truss 32. The reinforcing straps can be pulled down by a windlass, hydraulics, or lift bags, to snug the air bag into position. A drawstring cable 272 is used to draw the habitat bag 34 underneath the truss 32. As illustrated in FIG. 2 and FIG. 13 the air bag has a vent 258 at the top. The vent is closed and water is evacuated from the bag by pumping air into the bag so as to inflate the bag and force out the water. Honeycomb flooring 256 is then put in place on top of the "A" sections, the inner end 190 and the outer end 150. At this time the habitat is fully deployed.

In FIG. 1 there is illustrated an air compressor 300 on a platform 302. The platform 302 may be the ship undergoing inspection of the propeller 40; may be a barge or another ship; or may be on a dock. A pneumatic line connects with the air compressor 300 and passes underneath the truss 32 and then ends inside of the truss 32 so as to deliver air for inflating the air bag 34 to have a dry work environment around the upper part of the propeller blade 41.

With respect to FIG. 2 it is seen that there is an enlarged fragmentary portion illustrating the propeller shaft 39, the expandable bag 240 with the rubberized fabric 242 and the reinforcement straps 244. There is a opening 279 in the bag for fitting around the propeller shaft. It is seen that there is a reinforcing member 278 for fitting around the opening to reinforce the expandable bag 240.

Also, in FIG. 2 it is seen that there is a person 280 and welding equipment 282 inside of the habitat air bag 34. The person 280 is using a welding torch 284 to repair a crack 286 in the propeller blade 41. Again, the repairing of the propeller blade 41 is being performed while the ship is in the water 252 and part of the propeller is in the water. The habitat air bag 34 and the truss 32 provide a dry work environment for the person 280 using the welding equipment 282 and the torch 284.

FIG. 3A is a top plan view taken on line A—A of FIG. 3. FIG. 3A illustrates the connection of a "A" section 110 with either a "C" section 44 or a "C" section 42. It is seen that there is a bolt 288 in the vertical passageway in the rod 124 of "A" section 110. The rod 124 assists in connecting the "A" section and the "C" section.

Also, in FIG. 3A it is seen that there are bolts 290 in the holes or passageways 66 in the brace 72 of "C" section 44 or the brace in "C" section 42. These bolts 290 unite these two "C" sections.

FIG. 3B is a bottom plan view looking at the connection of the brace 100 of lower "C" section 48 with the "A" section 110 or of the brace 90 of the lower "C" section 46 with the "A" section 110. It is seen that there is a bolt and nut combination 292 connecting the two lower "C" sections 100 or the two lower "C" sections 90. Also, the "A" sections 110 are connected to the "C" sections 100 by a rod 106 having a passageway 66 for receiving a bolt.

In FIG. 4 it is seen that passageway 66 and the rod 106 can be aligned with the passageway 66 in the outer end connecting area 102 of the brace 100 or the passageway 66 in the outer end connecting area 92 of the brace 90.

9. Nondestructive Tests

Once deployed, metallurgical and nondestructive test methods are used for inspection in the propeller habitat. Full advantage is taken of the fact that the propeller being mounted in its working environment. This allows detailed rotational pitch and diameter inspection not usually available in a shop environment. The customer inspector, ABS inspector, det-norske veritas inspector, or ship owner can witness the inspection if desired. Access to the inspection area is by shallow diving, air lock or submersible. A simple face mask and emergency air pack can be carried by members of the inspection team or repair personnel.

10. Visual Inspection

Visual inspections can be as detailed as is required by time and service requirements. This can be as simple as numbering the propeller blades and making a video of each blade. This video can be viewed on the surface as the blade inspection is performed, or can be recorded and viewed later.

Conventional methods of nondestructive testing can be performed.

Typical methods are dye penetrant (pt), radiography (x-ray), or ultrasonic (ut). Most marine propeller alloys will allow one or more of these methods to be utilized.

11. Chemical Analysis of Blade Alloys

The dry environment allows spot chemical analysis to be performed. This type of analysis aids in selecting proper repair methods. Portable, in the habitat, x-ray and Optical Spectrographic chemical analysis will also be performed to identify propeller blade alloys as required.

12. Physical Measurements of Blade Condition

When ship propellers are damaged in service there is usually more than one possible fix, depending on the extent of the damage. Definition of the damaged blade shape can easily be performed in a dry habitat environment. This shape definition process can use pitch gages or x, y, z position recording devices. Surface contour and pitch gage information may be obtained and compared to the original blade requirement. If original information is not available then comparisons may be made between damaged and slightly less or undamaged blades. Repair decisions can be made on the exact blade condition while in the habitat 30.

a) Measurement with a Digitizing Arm

The dry work space provided by the habitat 30 allows for the use of a digitizing arm. Used in tandem with a computer and commercial cad (computer aid drafting) programs, a digitizing arm produces a three dimensional map of the propellers surface contours. Since the propeller is mounted on the actual working shaft its true working pitch, rake and skew can be recorded. Propeller repair data can be generated which meets or exceeds requirements as detailed in the "technical manual marine propeller inspection, repair, and certification", document number: navsea s9245-ar-tsm-010/prop, 0910-1p-000-5260. With reference to FIG. 1 there is illustrated a person 274 manipulating a digitizing arm 276 for inspecting a propeller blade 41.

13. Repair Environment

Cleaning and polishing of a propeller can be easily performed in a shop-type environment. Each blade can be rotated to a position for the most efficient working environment. Any conventional cleaning and polishing process can be employed. Final wet polishing can easily be performed. Any metal debris can be captured to eliminate environmental concerns.

14. Surface Coating

The habitat also allows for the application of surface coatings that are used to decrease cavitation of the propeller blades. Any of the common coatings can be applied in the habitat, including flame or metal spray, as well as the epoxy type coatings, like Belzona™.

15. Welding and Cutting

Since all work is performed in an air environment welding may be performed as a routine repair method. Cutting or cropping of blade tips is a simple task with abundant water for cooling. Any of the less volatile safety gases can be used in the habitat as the air vents and sensors ensure safe gas levels within the work chamber.

16. Mechanical Straightening and Machining

Standard industry practices of mechanical straightening can be applied. Given the size required for a mechanical straightening device, however, it is necessary that the device break down into components more easily handled. The mechanical straightening device is a slightly modified standard shop type load frame which is disassembled for transport to the habitat. The mechanical straightening device is reassembled around the damaged propeller blade. The blade can be machined after mechanical or thermal repair.

17. Thermal Stress Relief or Blade Heat Treatment

On blades which may have required extensive mechanical straightening, crack repair welding, or extensive heat straightening, it is standard shop practice to stress relieve the damaged blade. The use of a habitat will allow such thermal stress relief processes to be employed. Some blade alloys allow cropping and welding of a replacement piece with final machining done with the piece attached to the blade with the prop still on the ship.

18. Heat Source Selection for Blade Straightening

Some propeller blade alloys will respond to heat straightening with little or no damage to the base alloy metallurgy. Standard industry practices are employable within the dry work environment of the habitat. Since precision heat straightening in an underwater habitat is potentially dangerous. The first choice for a high temperature localized heat source will be the process of non-transferred plasma. The higher heat input nontransferable plasma is more controllable in the confines of the underwater habitat. The most important reason for using non-transferred plasma is that explosive gas formation is not present using this process. An alternative choice for heat will be a COMMERCIAL HIGH VAPOR PRESSURE PROPANE suitable for use at 2 atmospheres.

19. Final Dimensional Inspections and Permanent Records of Repair

Upon completion of repairs to the propeller, the 3-D (three-dimension) digitizing arm can be used to give a digital record of the finished contours of the propeller. When the propeller work is complete, the equipment is removed from the habitat which is then extracted in the reverse order of its deployment.

A habitat for encompassing a propeller on a ship while the ship is on the water and the propeller is in the water and comprising a truss for operatively connecting with said ship and juxtapositioned to said propeller; a habitat bag which is flexible, yieldable and expandable and of such a size as to fit over the upper part of said propeller; a first means for attaching said habitat bag to said truss; second means for introducing a gaseous fluid into said habitat bag for inflating the habitat bag with said gaseous fluid; said truss comprising a plurality of truss sections operatively connected together; and, a support on said truss for allowing a person to walk on said truss.

A habitat for encompassing a propeller on a ship while the ship is on the water and the propeller is in the water and comprising a truss for operatively connecting with said ship and juxtapositioned to said propeller; a habitat bag which is flexible, yieldable and expandable and of such a size as to fit over the upper part of said propeller; a first means for attaching said habitat bag to said truss; a second means for introducing a gaseous fluid into said habitat bag for inflating the habitat bag with said gaseous fluid; said ship having a propeller shaft; said propeller being on said propeller shaft; said propeller being on said propeller shaft; said truss having a third means for mounting said truss on said propeller shaft forwardly of said propeller; and, said truss having a fourth means for mounting said truss on said propeller shaft and aft of said propeller.

A habitat for encompassing a propeller on a ship while the ship is on the water and the propeller is in the water and comprising a truss for operatively connecting with said ship and juxtapositioned to said propeller; a habitat bag which is flexible, yieldable and expandable and of such a size as to fit over the upper part of said propeller; a first means for attaching said habitat bag to said truss; second means for introducing a gaseous fluid into said habitat bag for inflating the habitat bag with said gaseous fluid; said truss comprising a plurality of truss sections operatively connected together; a support on said truss for allowing a person to walk on said truss; said ship having a propeller shaft; said propeller being on said propeller shaft; said propeller being on said propeller shaft; said truss having a third means for mounting said truss on said propeller shaft forwardly of said propeller; said truss having a fourth means for mounting said truss on said propeller shaft and aft of said propeller; an air vent for allowing air to leave the habitat bag; an air lock connecting with said habitat bag and the surface of the water for allowing a person to enter said bag and to exit said bag without contacting said water; said habitat bag operatively connected to the lower part of said truss to assist in having a dry work environment inside of said habitat bag; a means recirculating air for introducing air into said habitat bag.

A process for positioning a habitat in an encompassing relationship to a propeller on a ship while the ship is on the water and the propeller is in the water, said process comprising assembling truss sections to form a truss for operatively connecting with said ship and to be juxtapositioned to said propeller and said propeller shaft; positioning over the upper part of said propeller a flexible, yieldable and expandable habitat bag; attaching said habitat bag to said truss; and, introducing gaseous fluid into said habitat bag for inflating said habitat bag with said gaseous fluid.

A process for positioning a habitat in an encompassing relationship to a propeller on a ship while the ship is on the water and the propeller is in the water, said process comprising assembling truss sections to form a truss for operatively connecting with said ship and to be juxtapositioned to said propeller and said propeller shaft; positioning over the upper part of said propeller a flexible, yieldable and expandable habitat bag; attaching said habitat bag to said truss; introducing gaseous fluid into said habitat bag for inflating said habitat bag with said gaseous fluid; positioning a support on said truss for allowing a person to walk on said truss; said ship having a propeller shaft; said propeller being on said propeller shaft; mounting part of said truss on said propeller shaft forwardly of said propeller; and, mounting part of said truss on said propeller shaft rearwardly of said propeller.

A process for positioning a habitat in an encompassing relationship to a propeller on a ship while the ship is on the water and the propeller is in the water, said process comprising assembling truss sections to form a truss for operatively connecting with said ship and to be juxtapositioned to said propeller and said propeller shaft; positioning over the upper part of said propeller a flexible, yieldable and expandable habitat bag; attaching said habitat bag to said truss; introducing gaseous fluid into said habitat bag for inflating said habitat bag with said gaseous fluid; connecting an air lock with said habitat bag and the surface of the water for allowing a person to enter said bag and to exit said bag without contacting said water; connecting an air vent to said habitat bag for allowing air to leave the habitat bag; operatively connecting said habitat bag to the lower part of said truss to assist in having a dry work environment inside of said bag; and, introducing air into said habitat bag.

A process for positioning a habitat in an encompassing relationship to a propeller on a ship while the ship is on the water and the propeller is in the water, said process comprising assembling truss sections to form a truss for operatively connecting with said ship and to be juxtapositioned to said propeller and said propeller shaft; positioning over the upper part of said propeller a flexible, yieldable and expandable habitat bag; attaching said habitat bag to said truss; introducing gaseous fluid into said habitat bag for inflating said habitat bag with said gaseous fluid; said truss comprising a plurality of sections identified as a first section, a second section, a third section, a fourth section, a plurality of fifth sections; said first section being positioned on top of said propeller shaft forwardly of said propeller; said second section being positioned on top of said propeller shaft aft of said propeller; uniting said first section and said second section; positioning said third section underneath and forwardly of said propeller shaft; positioning said fourth section underneath and aft of said propeller shaft; uniting said third section and fourth section; uniting said first section and said third section with said third section juxtapositioned to said propeller shaft; uniting said second section and said fourth section with said fourth section juxtapositioned to said propeller shaft; connecting said fifth sections to said first section and said third section; connecting said fifth sections to said second section and said fourth section; connecting said fifth sections together to form said truss of sufficient length to extend beyond the propeller; and, connecting end sections to said fifth sections which extend beyond propeller to form said truss which encompasses said propeller and part of said propeller.

A process for positioning a habitat in an encompassing relationship to a propeller on a ship while the ship is on the water and the propeller is in the water, said process comprising assembling truss sections to form a truss for operatively connecting with said ship and to be juxtapositioned to said propeller and said propeller shaft; positioning over the upper part of said propeller a flexible, yieldable and expandable habitat bag; attaching said habitat bag to said truss; introducing gaseous fluid into said habitat bag for inflating said habitat bag with said gaseous fluid; positioning a support on said truss for allowing a person to walk on said truss; said ship having a propeller shaft; said propeller being on said propeller shaft; mounting part of said truss on said propeller shaft forwardly of said propeller; mounting part of said truss on said propeller shaft rearwardly of said propeller; connecting an air lock with said habitat bag and the surface of the water for allowing a person to enter said bag and to exit said bag without contacting said water; connecting an air vent to said habitat bag for allowing air to leave the habitat bag; operatively connecting said habitat bag to the lower part of said truss to assist in having a dry work environment inside of said bag; introducing air into said habitat bag; said truss comprising a plurality of sections identified as a first section, a second section, a third section, a fourth section, a plurality of fifth sections; said first section being positioned on top of said propeller shaft forwardly of said propeller; said second section being positioned on top of said propeller shaft aft of said propeller; uniting said first section and said second section; positioning said third section underneath and forwardly of said propeller shaft; positioning said fourth section underneath and aft of said propeller shaft; uniting said third section and fourth section; uniting said first section and said third section with said third section juxtapositioned to said propeller shaft; uniting said second section and said fourth section with said fourth section juxtapositioned to said propeller shaft; connecting said fifth sections to said first section and said third section; connecting said fifth sections to said second section and said fourth section; connecting said fifth sections together to form said truss of sufficient length to extend beyond the propeller; and, connecting end sections to said fifth sections which extend beyond propeller to form said truss which encompasses said propeller and part of said propeller.

A habitat positioned in an encompassing relationship to a propeller on a ship while the ship is on the water and the propeller is in the water, said habitat being positioned by a process comprising assembling truss sections to operatively connect with said ship and to be juxtapositioned to said propeller; positioning over the upper part of said propeller a flexible, yieldable and expandable habitat bag; attaching said habitat bag to said truss; introducing a gaseous fluid into said habitat bag for inflating said habitat bag with said gaseous fluid; and, positioning a support on said truss for allowing a person to walk on said truss.

A habitat positioned in an encompassing relationship to a propeller on a ship while the ship is on the water and the propeller is in the water, said habitat being positioned by a process comprising assembling truss sections to operatively connect with said ship and to be juxtapositioned to said propeller; positioning over the upper part of said propeller a flexible, yieldable and expandable habitat bag; attaching said habitat bag to said truss; introducing a gaseous fluid into said habitat bag for inflating said habitat bag with said gaseous fluid; said ship having a propeller shaft; said propeller being on said propeller shaft; mounting part of said truss on said propeller shaft forwardly of said propeller; and, mounting part of said truss on said propeller shaft rearwardly of said propeller.

A combination of a ship comprising a propeller shaft and a propeller on said shaft and a habitat positioned in an operating relationship to said ship, said shaft and said propeller, and said habitat comprising a truss for operatively connecting with said ship and juxtapositioned to said propeller; a habitat bag which is flexible, yieldable and expandable and of such a size as to fit over the upper part of said propeller; a first means for attaching said habitat bag to said truss; a second means for introducing a gaseous fluid into said habitat bag for inflating said habitat bag with said gaseous fluid; said truss comprising a plurality of truss sections operatively connected together; and, a support on said truss for allowing a person to walk on said truss.

A combination of a ship comprising a propeller shaft and a propeller on said shaft and a habitat positioned in an operating relationship to said ship, said shaft and said propeller, and said habitat comprising a truss for operatively connecting with said ship and juxtapositioned to said propeller; a habitat bag which is flexible, yieldable and expandable and of such a size as to fit over the upper part of said propeller; a first means for attaching said habitat bag to said truss; a second means for introducing a gaseous fluid into said habitat bag for inflating said habitat bag with said gaseous fluid; said ship having a propeller shaft; said propeller being on said propeller shaft; said truss having a third means for mounting said truss on said propeller shaft forwardly of said propeller; and, said truss having a fourth means for mounting said propeller shaft aft of said propeller.

A habitat for encompassing a propeller and a propeller shaft on a ship and comprising said propeller being on said propeller shaft; a truss for operatively connecting and being positioned on said propeller shaft; a habitat bag which is flexible, yieldable and expandable and of such a size as to cover the upper part of said propeller; a first means for attaching said habitat bag to said truss; said truss comprising a plurality of truss sections operatively connected together; and, a support on said truss for allowing a person to walk on said truss.

A habitat for encompassing a propeller and a propeller shaft on a ship and comprising said propeller being on said propeller shaft; a truss for operatively connecting and being positioned on said propeller shaft; a habitat bag which is flexible, yieldable and expandable and of such a size as to cover the upper part of said propeller; a first means for attaching said habitat bag to said truss; said truss comprising a plurality of truss sections operatively connected together; a support on said truss for allowing a person to walk on said truss; said truss having a second means for mounting said truss on said propeller shaft forwardly of said propeller; and, said truss having a third means for mounting said truss on said propeller shaft aft of said propeller.

A process for positioning a habitat on a ship and in an encompassing relationship to a propeller shaft and a propeller on said propeller shaft, said process comprising assembling truss sections to form a truss for operatively connecting with said ship and to be juxtapositioned to said propeller and said propeller shaft; said truss being positioned on said propeller shaft; positioning over the upper part of said propeller a flexible, yieldable and expandable habitat bag; attaching said habitat bag to said truss; operatively connecting together a plurality of truss sections to form said truss; positioning a support on said truss to allow a person to walk on said truss; said ship having a propeller shaft; said propeller being on said propeller shaft; mounting said truss on said propeller shaft forwardly of said propeller; mounting said truss on said propeller shaft aft of said propeller; and, positioning a test instrument inside said habitat.

The positioning of a habitat on a ship and in an encompassing relationship to a propeller on said propeller shaft and comprising assembling truss sections to form a truss for operatively connecting with said ship and to be juxtapositioned to said propeller and said propeller shaft; said truss being positioned on said propeller shaft; positioning over the upper part of said propeller a flexible, yieldable and expandable habitat bag; attaching said habitat bag to said truss; operatively connecting together a plurality of truss sections to form said truss; and, positioning a support on said truss to allow a person to walk on said truss.

The positioning of a habitat on a ship and in an encompassing relationship to a propeller on said propeller shaft and comprising assembling truss sections to form a truss for operatively connecting with said ship and to be juxtapositioned to said propeller and said propeller shaft; said truss being positioned on said propeller shaft; positioning over the upper part of said propeller a flexible, yieldable and expandable habitat bag; attaching said habitat bag to said truss; operatively connecting together a plurality of truss sections to form said truss; positioning a support on said truss to allow a person to walk on said truss; said ship having a propeller shaft; said propeller being on said propeller shaft; mounting said truss on said propeller shaft forwardly of said propeller; mounting said truss on said propeller shaft aft of said propeller; positioning a test instrument inside of said habitat.

A method for assembling a truss on the propeller shaft having a propeller having propeller blades on a ship and comprising forming a first top section to be positioned on top of the propeller shaft and on the portside of said propeller shaft; forming a second top section to be positioned on top of the propeller shaft and on the starboard side of the propeller shaft; joining said first top section and said second top section to form a first top structure; forming a first bottom section to be positioned underneath said propeller shaft and on the portside of said propeller shaft; forming a second bottom section to be positioned underneath said propeller shaft and on the starboard side of said propeller shaft; joining said first bottom section and said second bottom section to form a first bottom structure; forming a second top structure; forming a second bottom structure; positioning said first top structure on top of said propeller shaft and forwardly of said propeller; positioning said first bottom structure underneath said propeller shaft and forwardly of said propeller; uniting said first top structure and said first bottom structure into a first integral structure; positioning said second top structure on top of said propeller shaft and aft of said propeller; positioning said second bottom structure underneath said propeller shaft and aft of said propeller; uniting said second top structure and said second bottom structure into a second integral structure; forming truss sections for attachment to said first integral structure, to said second integral structure and to each other; attaching said truss sections to the portside and to the starboard side of said first integral structure; attaching said truss sections to said truss sections attached to said first integral structure to have said truss sections extend beyond said propeller blades to allow the propeller to rotate; attaching said truss sections to said truss sections attached to said second integral structure to have said truss sections extend beyond said propeller blades to allow the propeller to rotate; connecting the outer portside truss sections; connecting the outer starboard truss sections to encompass the propeller blades while allowing the propeller blades to rotate; positioning a flexible, yieldable and expandable habitat bag, of such a size as to fit over the upper part of said propeller; and, attaching said habitat bag to said truss.

A method for assembling a truss on the propeller shaft having a propeller having propeller blades on a ship and comprising forming a first top section to be positioned on top of the propeller shaft and on the portside of said propeller shaft; forming a second top section to be positioned on top of the propeller shaft and on the starboard side of the propeller shaft; joining said first top section and said second top section to form a first top structure; forming a first bottom section to be positioned underneath said propeller shaft and on the portside of said propeller shaft; forming a second bottom section to be positioned underneath said propeller shaft and on the starboard side of said propeller shaft; joining said first bottom section and said second bottom section to form a first bottom structure; forming a second top structure; forming a second bottom structure; positioning said first top structure on top of said propeller shaft and forwardly of said propeller; positioning said first bottom structure underneath said propeller shaft and forwardly of said propeller; uniting said first top structure and said first bottom structure into a first integral structure; positioning said second top structure on top of said propeller shaft and aft of said propeller; positioning said second bottom structure underneath said propeller shaft and aft of said propeller; uniting said second top structure and said second bottom structure into a second integral structure; forming truss sections for attachment to said first integral structure, to said second integral structure and to each other; attaching said truss sections to the portside and to the starboard side of said first integral structure; attaching said truss sections to said truss sections attached to said first integral structure to have said truss sections extend beyond said propeller blades to allow the propeller to rotate; attaching said truss sections to said truss sections attached to said second integral structure to have said truss sections extend beyond said propeller blades to allow the propeller to rotate; connecting the outer portside truss sections; connecting the outer starboard truss sections to encompass the propeller blades while allowing the propeller blades to rotate; positioning a flexible, yieldable and expandable habitat bag, of such a size as to fit over the upper part of said propeller; attaching said habitat bag to said truss; part of said propeller being in the water; positioning said truss, in the water, on said propeller shaft in the water; and, positioning a test instrument inside of said habitat.

A method for assembling a truss on the propeller shaft, having a propeller having propeller blades, on a ship and comprising uniting a first top section and a first bottom section to form a first portside section; uniting a second top section and a second bottom section to form a first starboard section; forming another portside section; forming another starboard section; juxtapositioning said first portside section to the propeller shaft and forwardly of said propeller; juxtapositioning said first starboard section to the propeller shaft and forwardly of said propeller; uniting said first portside section and said first starboard section into a first integral structure; juxtapositioning said another portside section to the propeller shaft and aft of said propeller; juxtapositioning said another starboard section to the propeller shaft and aft of said propeller; uniting said another portside section and said another starboard section into a second integral structure; forming truss sections for attachment to said first integral structure, to said second integral structure and to each other; attaching said truss sections to the portside and to the starboard side of said first integral structure; attaching said truss sections to said truss sections attached to said first integral structure to have said truss sections extend beyond said propeller blades to allow the propeller to rotate; attaching said truss sections to said truss sections attached to said second integral structure to have said truss sections extend beyond said propeller blades to allow the propeller to rotate; connecting the outer portside truss sections; connecting the outer starboard truss sections to encompass the propeller blades while allowing the propeller blades to rotate; positioning a flexible, yieldable and expandable habitat bag, of such a size as to fit over the upper part of said propeller, over said propeller.

A method for assembling a truss on the propeller shaft, having a propeller having propeller blades, on a ship and comprising uniting a first top section and a first bottom section to form a first portside section; uniting a second top section and a second bottom section to form a first starboard section; forming another portside section; forming another starboard section; juxtapositioning said first portside section to the propeller shaft and forwardly of said propeller; juxtapositioning said first starboard section to the propeller shaft and forwardly of said propeller; uniting said first portside section and said first starboard section into a first integral structure; juxtapositioning said another portside section to the propeller shaft and aft of said propeller; juxtapositioning said another starboard section to the propeller shaft and aft of said propeller; uniting said another portside section and said another starboard section into a second integral structure; forming truss sections for attachment to said first integral structure, to said second integral structure and to each other; attaching said truss sections to the portside and to the starboard side of said first integral structure; attaching said truss sections to said truss sections attached to said first integral structure to have said truss sections extend beyond said propeller blades to allow the propeller to rotate; attaching said truss sections to said truss sections attached to said second integral structure to have said truss sections extend beyond said propeller blades to allow the propeller to rotate; connecting the outer portside truss sections; connecting the outer starboard truss sections to encompass the propeller blades while allowing the propeller blades to rotate; part of said propeller being in water; positioning said truss, in the water, on said propeller shaft in the water; positioning a flexible, yieldable and expandable habitat bag, of such a size as to fit over the upper part of said propeller, over said propeller; attaching said habitat bag to said truss; inflating said habitat bag to fit over and to enclose the upper part of said propeller blades; and, positioning a test instrument inside of said habitat.

A method for assembling a truss on the propeller shaft, having a propeller having propeller blades, on a ship and comprising uniting a first top section and a first bottom section to form a first portside section; uniting a second top section and a second bottom section to form a first starboard section; forming another portside section; forming another starboard section; uniting said first top section of said first portside section with said second top section of said first starboard section and move apart said first bottom section and said second bottom section to form a first structure; uniting said first top section of said another portside section with said second top section of said another starboard section and move apart said first bottom section of said another portside section and said second bottom section of said another starboard section to form a second structure; positioning said first structure adjacent to said propeller shaft and forwardly of said propeller; moving said first bottom section and said second bottom section of said first structure toward each other and uniting said first bottom section and said bottom section to form a first integral structure; positioning said second structure adjacent to said propeller shaft and aft of said propeller; moving said first bottom section and said second bottom section of said second structure toward each other and uniting said first bottom section and said second bottom section to form a second integral structure; forming truss sections for attachment to said first integral structure, to said second integral structure and to each other; attaching said truss sections to the portside and to the starboard side of said first integral structure; attaching said truss sections to said truss sections attached to said first integral structure to have said truss sections extend beyond said propeller blades to allow the propeller to rotate; attaching said truss sections to said truss sections attached to said second integral structure to have said truss sections extend beyond said propeller blades to allow the propeller to rotate; connecting the outer portside truss sections; connecting the outer starboard truss sections to encompass the propeller blades while allowing the propeller blades to rotate; and, positioning a flexible, yieldable and expandable habitat bag, of such a size as to fit over the upper part of said propeller, over said propeller.

A method for assembling a truss on the propeller shaft, having a propeller having propeller blades, on a ship and comprising uniting a first top section and a first bottom section to form a first portside section; uniting a second top section and a second bottom section to form a first starboard section; forming another portside section; forming another starboard section; uniting said first top section of said first portside section with said second top section of said first starboard section and move apart said first bottom section and said second bottom section to form a first structure; uniting said first top section of said another portside section with said second top section of said another starboard section and move apart said first bottom section of said another portside section and said second bottom section of said another starboard section to form a second structure; positioning said first structure adjacent to said propeller shaft and forwardly of said propeller; moving said first bottom section and said second bottom section of said first structure toward each other and uniting said first bottom section and said bottom section to form a first integral structure; positioning said second structure adjacent to said propeller shaft and aft of said propeller; moving said first bottom section and said second bottom section of said second structure toward each other and uniting said first bottom section and said second bottom section to form a second integral structure; forming truss sections for attachment to said first integral structure, to said second integral structure and to each other; attaching said truss sections to the portside and to the starboard side of said first integral structure; attaching said truss sections to said truss sections attached to said first integral structure to have said truss sections extend beyond said propeller blades to allow the propeller to rotate; attaching said truss sections to said truss sections attached to said second integral structure to have said truss sections extend beyond said propeller blades to allow the propeller to rotate; connecting the outer portside truss sections; connecting the outer starboard truss sections to encompass the propeller blades while allowing the propeller blades to rotate; part of said propeller being in water; positioning said truss, in the water, on said propeller shaft in the water; positioning a flexible, yieldable and expandable habitat bag, of such a size as to fit over the upper part of said propeller, over said propeller; attaching said habitat bag to said truss; inflating said habitat bag to fit over and to enclose the upper part of said propeller blades; and, positioning a test instrument inside of said habitat.

A method for assembling a truss on the propeller shaft having a propeller having propeller blades on a ship and comprising forming a first top section to be positioned on top of the propeller shaft and on the portside of said propeller shaft; forming a second top section to be positioned on top of the propeller shaft and on the starboard side of the propeller shaft; joining said first top section and said second top section to form a first top structure; forming a first bottom section to be positioned underneath said propeller shaft and on the portside of said propeller shaft; forming a second bottom section to be positioned underneath said propeller shaft and on the starboard of said propeller shaft; joining said first bottom section and said second bottom section to form a first bottom structure; forming a second top structure; forming a second bottom structure; identifying said first top structure; identifying said second top structure as a second integral structure; forming truss sections for attachment to said first integral structure, to said second integral structure and to each other; attaching said truss sections to the portside and to the starboard side of said first integral structure; attaching said truss sections to said truss sections attached to said first integral structure to have said truss sections extend beyond said propeller blades to allow the propeller to rotate; attaching said truss sections to said truss sections attached to said second integral structure to have said truss sections extend beyond said propeller blades to allow the propeller to rotate; connecting the outer portside truss sections; connecting the outer starboard truss sections to encompass the propeller blades while allowing the propeller blades to rotate; positioning said substantially complete truss adjacent to said propeller shaft with said first integral structure forward of said propeller and with said second integral structure aft of said propeller; positioning said first bottom section underneath said propeller shaft and forward of said propeller; uniting said first bottom section with said first integral structure; positioning said second bottom section underneath said propeller shaft and aft of said propeller; uniting said second bottom section with said second integral structure; and, positioning a flexible, yieldable and expandable habitat bag, of such a size as to fit over the upper part of said propeller, over said propeller.

A method for assembling a truss on the propeller shaft having a propeller having propeller blades on a ship and comprising forming a first top section to be positioned on top of the propeller shaft and on the portside of said propeller shaft; forming a second top section to be positioned on top of the propeller shaft and on the starboard side of the propeller shaft; joining said first top section and said second top section to form a first top structure; forming a first bottom section to be positioned underneath said propeller shaft and on the portside of said propeller shaft; forming a second bottom section to be positioned underneath said propeller shaft and on the starboard of said propeller shaft; joining said first bottom section and said second bottom section to form a first bottom structure; forming a second top structure; forming a second bottom structure; identifying said first top structure; identifying said second top structure as a second integral structure; forming truss sections for attachment to said first integral structure, to said second integral structure and to each other; attaching said truss sections to the portside and to the starboard side of said first integral structure; attaching said truss sections to said truss sections attached to said first integral structure to have said truss sections extend beyond said propeller blades to allow the propeller to rotate; attaching said truss sections to said truss sections attached to said second integral structure to have said truss sections extend beyond said propeller blades to allow the propeller to rotate; connecting the outer portside truss sections; connecting the outer starboard truss sections to encompass the propeller blades while allowing the propeller blades to rotate; positioning said substantially complete truss adjacent to said propeller shaft with said first integral structure forward of said propeller and with said second integral structure aft of said propeller; positioning said first bottom section underneath said propeller shaft and forward of said propeller; uniting said first bottom section with said first integral structure; positioning said second bottom section underneath said propeller shaft and aft of said propeller; uniting said second bottom section with said second integral structure; said propeller shaft and said propeller being in water; positioning said truss, in the water, on said propeller shaft in the water; positioning a flexible, yieldable and expandable habitat bag, of such a size as to fit over the upper part of said propeller, over said propeller; attaching said habitat bag to said truss; inflating said habitat bag to fit over and to enclose the upper part of said propeller blades; and, positioning a test instrument inside of said habitat.

A method for assembling a truss on the propeller shaft, having a propeller having propeller blades, on a ship and comprising forming a first top section to be positioned on top of the propeller shaft and on the portside of said propeller shaft; forming a second top section to be positioned on top of the propeller shaft and on the starboard side of the propeller shaft; forming another first top section; forming another second top section; forming a first bottom section to be positioned underneath said propeller shaft and on the portside of said propeller shaft; forming a second bottom section to be positioned underneath said propeller shaft and on the starboard side of said propeller shaft; forming another first bottom section; forming another second bottom section; positioning said first top section above said propeller shaft and on the portside of said propeller shaft and forwardly of the propeller; positioning said second top section above said propeller shaft and on the starboard side of said propeller shaft and forwardly of the propeller; uniting said first top section and said second top section to be adjacent to and above said propeller shaft to form a first top structure; positioning said another first top section on the portside of said propeller shaft and aft of the propeller; positioning said another second top section on the starboard side of said propeller shaft and aft of the propeller; uniting said another first top section and said another second top section to be adjacent to and above said propeller shaft to form a second top structure; positioning said first bottom section under said propeller shaft and on the portside of said propeller shaft and forwardly of the propeller; positioning said second bottom section under said propeller shaft and on the starboard side of said propeller shaft and forwardly of the propeller; uniting said first bottom section and said section bottom section to be adjacent to and below said propeller shaft to form a first bottom structure forwardly of the propeller; positioning said another first bottom section under said propeller shaft and on the portside of said propeller shaft and aft of the propeller; positioning said another second bottom section under said propeller shaft and on the starboard side of said propeller shaft and aft of the propeller; uniting said another first bottom section and said another second bottom section to be adjacent to and below said propeller shaft to form a second bottom structure aft of said propeller; uniting said first top structure and said first bottom structure into a first integral structure; uniting said second top structure and said second bottom structure into a second integral structure; forming truss sections for attachment to said first integral structure, to said second integral structure and to each other; attaching said truss sections to the portside and to the starboard side of said first integral structure; attaching said truss sections to said truss sections attached to said first integral structure to have said truss sections extend beyond said propeller blades to allow the propeller to rotate; attaching said truss sections to said truss sections attached to said second integral structure to have said truss sections extend beyond said propeller blades to allow the propeller to rotate; connecting the outer portside truss sections; connecting the outer starboard truss sections to encompass the propeller blades while allowing the propeller blades to rotate; and, positioning a flexible, yieldable and expandable habitat bag, of such a size as to fit over the upper part of said propeller, over said propeller.

A method for assembling a truss on the propeller shaft, having a propeller having propeller blades, on a ship and comprising forming a first top section to be positioned on top of the propeller shaft and on the portside of said propeller shaft; forming a second top section to be positioned on top of the propeller shaft and on the starboard side of the propeller shaft; forming another first top section; forming another second top section; forming a first bottom section to be positioned underneath said propeller shaft and on the portside of said propeller shaft; forming a second bottom section to be positioned underneath said propeller shaft and on the starboard side of said propeller shaft; forming another first bottom section; forming another second bottom section; positioning said first top section above said propeller shaft and on the portside of said propeller shaft and forwardly of the propeller; positioning said second top section above said propeller shaft and on the starboard side of said propeller shaft and forwardly of the propeller; uniting said first top section and said second top section to be adjacent to and above said propeller shaft to form a first top structure; positioning said another first top section on the portside of said propeller shaft and aft of the propeller; positioning said another second top section on the starboard side of said propeller shaft and aft of the propeller; uniting said another first top section and said another second top section to be adjacent to and above said propeller shaft to form a second top structure; positioning said first bottom section under said propeller shaft and on the portside of said propeller shaft and forwardly of the propeller; positioning said second bottom section under said propeller shaft and on the starboard side of said propeller shaft and forwardly of the propeller; uniting said first bottom section and said section bottom section to be adjacent to and below said propeller shaft to form a first bottom structure forwardly of the propeller; positioning said another first bottom section under said propeller shaft and on the portside of said propeller shaft and aft of the propeller; positioning said another second bottom section under said propeller shaft and on the starboard side of said propeller shaft and aft of the propeller; uniting said another first bottom section and said another second bottom section to be adjacent to and below said propeller shaft to form a second bottom structure aft of said propeller; uniting said first top structure and said first bottom structure into a first integral structure; uniting said second top structure and said second bottom structure into a second integral structure; forming truss sections for attachment to said first integral structure, to said second integral structure and to each other; attaching said truss sections to the portside and to the starboard side of said first integral structure; attaching said truss sections to said truss sections attached to said first integral structure to have said truss sections extend beyond said propeller blades to allow the propeller to rotate; attaching said truss sections to said truss sections attached to said second integral structure to have said truss sections extend beyond said propeller blades to allow the propeller to rotate; connecting the outer portside truss sections; connecting the outer starboard truss sections to encompass the propeller blades while allowing the propeller blades to rotate; part of said propeller being in water; positioning said truss, in the water, on said propeller shaft in the water; positioning a flexible, yieldable and expandable habitat bag, of such a size as to fit over the upper part of said propeller, over said propeller; attaching said habitat bag to said truss; inflating said habitat bag to fit over and to enclose the upper part of said propeller blades; positioning a test instrument inside of said habitat.

A process for evaluating a propeller on the propeller shaft on a ship and comprising assembling truss sections to form a truss for operatively connecting with said ship and to be juxtapositioned to said propeller and said propeller shaft; supporting said truss on said propeller shaft; positioning over the upper part of said propeller a habitat bag; inside of said habitat bag evaluating said propeller; repairing said propeller; and, assembling said truss sections to encompass said propeller while allowing said propeller to rotate.

A process for evaluating a propeller on the propeller shaft on a ship and comprising assembling truss sections to form a truss for operatively connecting with said ship and to be juxtapositioned to said propeller and said propeller shaft; supporting said truss on said propeller shaft; positioning over the upper part of said propeller a habitat bag; inside of said habitat bag evaluating said propeller; repairing said propeller; assembling said truss sections to encompass said propeller while allowing said propeller to rotate; positioning said ship in water with part of said propeller in the water; selecting a habitat bag which is flexible, yieldable and expandable; introducing gaseous fluid into said habitat bag for inflating said habitat bag with said gaseous fluid; and, repairing said propeller.

A propeller on the propeller shaft on a ship evaluated by a process comprising assembling truss sections to form a truss for operatively connecting with said ship and to be juxtapositioned to said propeller and said propeller shaft; supporting said truss on said propeller shaft; positioning over the upper part of said propeller a habitat bag; inside of said habitat bag evaluating said propeller; repairing said propeller; and, assembling said truss sections to encompass said propeller while allowing said propeller to rotate.

A propeller on the propeller shaft on a ship evaluated by a process comprising assembling truss sections to form a truss for operatively connecting with said ship and to be juxtapositioned to said propeller and said propeller shaft; supporting said truss on said propeller shaft; positioning over the upper part of said propeller a habitat bag; inside of said habitat bag evaluating said propeller; repairing said propeller; assembling said truss sections to encompass said propeller while allowing said propeller to rotate; positioning said ship in water with said propeller in the water and said truss in the water; selecting a habitat bag which is flexible, yieldable and expandable; and, introducing gaseous fluid into said habitat bag for inflating said habitat bag with said gaseous fluid.

What I claim is:

1. A habitat for encompassing a propeller on a ship while the ship is on the water and the propeller is in the water and comprising:

a. a truss for operatively connecting with said ship and juxtapositioned to said propeller;

b. a habitat bag which is flexible, yieldable and expandable and of such a size as to fit over the upper part of said propeller;

c. a first means for attaching said habitat bag to said truss; and, d. a second means for introducing a gaseous fluid into said habitat bag for inflating the habitat bag with said gaseous fluid.

2. A habitat according to claim 1 and comprising:

a. said truss comprising a plurality of truss sections operatively connected together; and, b. a support on said truss for allowing a person to walk on said truss.

3. A habitat according to claim 1 and comprising:

a. said ship having a propeller shaft;

b. said propeller being on said propeller shaft;

c. said truss having a third means for mounting said truss on said propeller shaft and forwardly of said propeller; and, d. said truss having a fourth means for mounting said truss on said propeller shaft aft of said propeller.

4. A habitat according to claim 2 and comprising:

a. said ship having a propeller shaft;

b. said propeller being on said propeller shaft;

c. said truss having a third means for mounting said truss on said propeller shaft forwardly of said propeller; and, d. said truss having a fourth means for mounting said truss on said propeller shaft and aft of said propeller.

5. A habitat according to claim 1 and comprising:

a. an air vent for allowing air to leave the habitat bag.

6. A habitat according to claim 1 and comprising:

a. an air lock connecting with said habitat bag and the surface of the water for allowing a person to enter said bag and to exit said bag without contacting said water.

7. A habitat according to claim 1 and comprising:

a. said habitat bag operatively connecting to the lower part of said truss to assist in having a dry work environment inside of said habitat bag.

8. A habitat according to claim 1 and comprising:

a. a means for recirculating air and for introducing air into said habitat bag.

9. A habitat according to claim 1 and comprising:

a. an air vent for allowing air to leave the habitat bag;

b. an air lock connecting with said habitat bag and the surface of the water for allowing a person to enter said bag and to exit said bag without contacting said water;

c. said habitat bag operatively connecting to the lower part of said truss to assist in having a dry work environment inside of said habitat bag; and, d. a means for recirculating air and for introducing air into said habitat bag.

10. A habitat according to claim 4 and comprising:

a. an air vent for allowing air to leave the habitat bag;

b. an air lock connecting with said habitat bag and the surface of the water for allowing a person to enter said bag and to exit said bag without contacting said water;

c. said habitat bag operatively connecting to the lower part of said truss to assist in having a dry work environment inside of said habitat bag; and, d. a means for recirculating air and for introducing air into said habitat bag.

11. A habitat according to claim 1 and comprising:

a. a test instrument inside of said habitat for testing said propeller.

12. A process for positioning a habitat in an encompassing relationship to a propeller on a ship while the ship is on the water and the propeller is in the water, said process comprising:

a. assembling truss sections to form a truss for operatively connecting with said ship and to be juxtapositioned to said propeller and said propeller shaft;

b. positioning over the upper part of said propeller a flexible, yieldable and expandable habitat bag;

c. attaching said habitat bag to said truss; and, d. introducing gaseous fluid into said habitat bag for inflating said habitat bag with said gaseous fluid.

13. A process according to claim 12 and comprising:

a. positioning a support on said truss for allowing a person to walk on said truss.

14. A process according to claim 12 and comprising:

a. said ship having a propeller shaft;

b. said propeller being on said propeller shaft;

c. mounting part of said truss on said propeller shaft forwardly of said propeller; and, d. mounting part of said truss on said propeller shaft rearwardly of said propeller.

15. A process according to claim 13 and comprising:

a. said ship having a propeller shaft;

b. said propeller being on said propeller shaft;

c. mounting part of said truss on said propeller shaft forwardly of said propeller; and, d. mounting part of said truss on said propeller shaft rearwardly of said propeller.

16. A process according to claim 12 and comprising:

a. connecting an air lock with said habitat bag and the surface of the water for allowing a person to enter said bag and to exit said bag without contacting said water.

17. A process according to claim 12 and comprising:

a. connecting an air vent to said habitat bag for allowing air to leave the habitat bag.

18. A process according to claim 12 and comprising:

a. operatively connecting said habitat bag to the lower part of said truss to assist in having a dry work environment inside of said bag.

19. A process according to claim 12 and comprising:

a. introducing air into said habitat bag.

20. A process according to claim 12 and comprising:

a. connecting an air lock with said habitat bag and the surface of the water for allowing a person to enter said bag and to exit said bag without contacting said water;

b. connecting an air vent to said habitat bag for allowing air to leave the habitat bag;

c. operatively connecting said habitat bag to the lower part of said truss to assist in having a dry work environment inside of said bag; and, d. introducing air into said habitat bag.

21. A process according to claim 15 and comprising:

a. connecting an air lock with said habitat bag and the surface of the water for allowing a person to enter said bag and to exit said bag without contacting said water;

b. connecting an air vent to said habitat bag for allowing air to leave the habitat bag;

c. operatively connecting said habitat bag to the lower part of said truss to assist in having a dry work environment inside of said bag; and, d. introducing air into said habitat bag.

22. A process according to claim 12 and comprising:

a. said truss comprising a plurality of sections identified as a first section, a second section, a third section, a fourth section, and a plurality of fifth sections;

b. said first section being positioned on top of said propeller shaft forwardly of said propeller;

c. said second section being positioned on top of said propeller shaft aft of said propeller;

d. uniting said first section and said second section;

e. positioning said third section underneath and forwardly of said propeller shaft;

f. positioning said fourth section underneath and aft of said propeller shaft;

g. uniting said third section and fourth section;

h. uniting said first section and said third section with said third section juxtapositioned to said propeller shaft;

i. uniting said second section and said fourth section with said fourth section juxtapositioned to said propeller shaft;

j. connecting said fifth sections to said first section and said third section;

k. connecting said fifth sections to said second section and said fourth section;

l. connecting said fifth sections together to form said truss of sufficient length to extend beyond the propeller; and, m. connecting end sections to said fifth sections which extend beyond said propeller to form said truss which encompasses said propeller and part of said propeller shaft and allows said propeller to rotate in said truss.

23. A process according to claim 12 and comprising:

a. positioning a test instrument inside of said habitat for testing said propeller.

24. A habitat positioned in an encompassing relationship to a propeller on a ship while the ship is on the water and the propeller is in the water, said habitat being positioned by a process comprising:

a. assembling truss sections to operatively connect with said ship and to be juxtapositioned to said propeller;

b. positioning over the upper part of said propeller a flexible, yieldable and expandable habitat bag;

c. attaching said habitat bag to said truss; and, d. introducing a gaseous fluid into said habitat bag for inflating said habitat bag with said gaseous fluid.

25. A habitat positioned by a process according to claim 24 and comprising:

a. positioning a support on said truss for allowing a person to walk on said truss.

26. A habitat positioned by a process according to claim 24 and comprising:

a. said ship having a propeller shaft;

b. said propeller being on said propeller shaft;

c. mounting part of said truss on said propeller shaft forwardly of said propeller; and, d. mounting part of said truss on said propeller shaft rearwardly of said propeller.

27. A habitat positioned by a process according to claim 25 and comprising:

a. said ship having a propeller shaft;

b. said propeller being on said propeller shaft;

c. said truss having a third means for mounting said truss on said propeller shaft forwardly of said propeller; and, d. said truss having a fourth means for mounting said propeller shaft aft of said propeller.

28. A habitat positioned by a process according to claim 24 and comprising:

a. positioning a test instrument inside of said habitat for testing said propeller.

29. A combination of a ship comprising a propeller shaft and a propeller on said shaft and a habitat positioned in an operating relationship to said ship, said shaft and said propeller, and said habitat comprising:

a. a truss for operatively connecting with said ship and juxtapositioned to said propeller;

b. a habitat bag which is flexible, yieldable and expandable and of such a size as to fit over the upper part of said propeller;

c. a first means for attaching said habitat bag to said truss; and, d. a second means for introducing a gaseous fluid into said habitat bag for inflating said habitat bag with said gaseous fluid.

30. A combination according to claim 29 and comprising:

a. said truss comprising a plurality of truss sections operatively connected together; and, b. a support on said truss for allowing a person to walk on said truss.

31. A combination according to claim 29 and comprising:

a. said ship having a propeller shaft;

b. said propeller being on said propeller shaft;

c. said truss having a third means for mounting on said truss on said propeller shaft forwardly of said propeller; and, d. said truss having a fourth means for mounting said propeller shaft aft of said propeller.

32. A combination according to claim 30 and comprising:

a. said ship having a propeller shaft;

b. said propeller being on said propeller shaft;

c. said truss having a third means for mounting said truss on said propeller shaft forwardly of said propeller; and, d. said truss having a fourth means for mounting said truss on said propeller shaft aft of said propeller.

33. A combination according to claim 29 and comprising:

a. positioning a test instrument inside of said habitat.

34. A process for forming a combination of a ship, a propeller shaft, a propeller on said shaft, and a habitat positioned in an operating relationship to said ship, said shaft and said propeller, and comprising:

a. assembling truss sections to form a truss for operatively connecting with said ship and to be juxtapositioned to said propeller and said propeller shaft;

b. positioning over the upper part of said propeller a flexible, yieldable and expandable habitat bag;

c. attaching said habitat bag to said truss; and d. introducing a gaseous fluid into said habitat bag for inflating said habitat bag with said gaseous fluid.

35. A process according to claim 34 and comprising:

a. positioning a support on said truss for allowing a person to walk on said truss.

36. A process according to claim 34 and comprising:

a. said ship having a propeller shaft;

b. said propeller being on said propeller shaft;

c. mounting part of said truss on said propeller shaft forwardly of said propeller; and, d. mounting part of said truss on said propeller shaft rearwardly of said propeller.

37. A process according to claim 35 and comprising:

a. said ship having a propeller shaft;

b. said propeller being on said propeller shaft;

c. mounting part of said truss on said propeller shaft forwardly of said propeller; and, d. mounting part of said truss on said propeller shaft rearwardly of said propeller.

38. A process according to claim 34 and comprising:

a. positioning a test instrument inside of said habitat.

39. A combination of a ship comprising a propeller shaft and a propeller on said shaft, and a habitat positioned in an operating relationship to said ship, said shaft and said propeller, and made by a process comprising:

a. assembling truss sections to form a truss for operatively connecting with said ship and to be juxtapositioned to said propeller and said propeller shaft;

b. positioning over the upper part of said propeller a flexible, yieldable and expandable habitat bag;

c. attaching said habitat bag to said truss; and, d. introducing gaseous fluid into said habitat bag for inflating said habitat bag with said gaseous fluid.

40. A combination according to claim 39 made by a process comprising:

a. positioning a support on said truss for allowing a person to walk on said truss.

41. A combination according to claim 39 and made by a process comprising:

a. said ship having a propeller shaft;

b. said propeller being on said propeller shaft;

c. mounting part of said truss on said propeller shaft forwardly of said propeller; and, d. mounting part of said truss on said propeller shaft rearwardly of said propeller.

42. A combination according to claim 40 and made by a process comprising:

a. said ship having a propeller shaft;

b. said propeller being on said propeller shaft;

c. mounting part of said truss on said propeller shaft forwardly of said propeller; and, d. mounting part of said truss on said propeller shaft rearwardly of said propeller.

43. A combination according to claim 39 and made by a process comprising:

a. positioning a test instrument inside of said habitat.

44. A habitat for encompassing a propeller and a propeller shaft on a ship and comprising:

a. said propeller being on said propeller shaft;

b. a truss for operatively connecting with said propeller shaft and being positioned on said propeller shaft;

c. a habitat bag which is flexible, yieldable and expandable and of such a size as to cover the upper part of said propeller; and, d. a first means for attaching said habitat bag to said truss.

45. A habitat according to claim 44 and comprising:

a. said truss comprising a plurality of truss sections operatively connected together; and, b. a support on said truss for allowing a person to walk on said truss.

46. A habitat according to claim 45 and comprising:

a. said truss having a second means for mounting said truss on said propeller shaft forwardly of said propeller; and, b. said truss having a third means for mounting said truss on said propeller shaft aft of said propeller.

47. A habitat according to claim 45 and comprising:

a. a test instrument inside of said habitat.

48. A process for positioning a habitat on a ship and in an encompassing relationship to a propeller shaft and a propeller on said propeller shaft, said process comprising:

a. assembling truss sections to form a truss for operatively connecting with said ship and to be juxtapositioned to said propeller and said propeller shaft;

b. said truss being positioned on said propeller shaft;

c. positioning over the upper part of said propeller a flexible, yieldable and expandable habitat bag; and, d. attaching said habitat bag to said truss.

49. A process according to claim 48 and comprising:

a. operatively connecting together a plurality of truss sections to form said truss; and, b. positioning a support on said truss to allow a person to walk on said truss.

50. A process according to claim 48 and comprising:

a. said ship having a propeller shaft;

b. said propeller being on said propeller shaft;

c. mounting said truss on said propeller shaft forwardly of said propeller; and, d. mounting said truss on said propeller shaft aft of said propeller.

51. A process according to claim 48 and comprising:

a. positioning a test instrument inside said habitat.

52. The positioning of a habitat on a ship and in an encompassing relationship to a propeller on said propeller shaft and comprising:

a. assembling truss sections to form a truss for operatively connecting with said ship and to be juxtapositioned to said propeller and said propeller shaft;

b. said truss being positioned on said propeller shaft;

c. positioning over the upper part of said propeller a flexible, yieldable and expandable habitat bag; and, d. attaching said habitat bag to said truss.

53. The positioning of a habitat on a ship according to claim 52 and comprising:

a. operatively connecting together a plurality of truss sections to form said truss; and, b. positioning a support on said truss to allow a person to walk on said truss.

54. The positioning of a habitat on a ship according to the process of claim 52 and comprising:

a. said ship having a propeller shaft;

b. said propeller being on said propeller shaft;

c. mounting said truss on said propeller shaft forwardly of said propeller; and, d. mounting said truss on said propeller shaft aft of said propeller.

55. The positioning of a habitat on a ship according to claim 52 and comprising:

a. positioning a test instrument inside of said habitat.

56. A method for assembling a truss on the propeller shaft having a propeller having propeller blades on a ship and comprising:

a. forming a first top section to be positioned on top of the propeller shaft and on the portside of said propeller shaft;

b. forming a second top section to be positioned on top of the propeller shaft and on the starboard side of the propeller shaft;

c. joining said first top section and said second top section to form a first top structure;

d. forming a first bottom section to be positioned underneath said propeller shaft and on the portside of said propeller shaft;

e. forming a second bottom section to be positioned underneath said propeller shaft and on the starboard side of said propeller shaft;

f. joining said first bottom section and said second bottom section to form a first bottom structure;

g. forming a second top structure;

h. forming a second bottom structure;

i. positioning said first top structure on top of said propeller shaft and forwardly of said propeller;

j. positioning said first bottom structure underneath said propeller shaft and forwardly of said propeller;

k. uniting said first top structure and said first bottom structure into a first integral structure;

l. positioning said second top structure on top of said propeller shaft and aft of said propeller;

m. positioning said second bottom structure underneath said propeller shaft and aft of said propeller;

n. uniting said second top structure and said second bottom structure into a second integral structure;

o. forming truss sections for attachment to said first integral structure, to said second integral structure and to each other;

p. attaching said truss sections to the portside and to the starboard side of said first integral structure;

q. attaching said truss sections to said truss sections attached to said first integral structure to have said truss sections extend beyond said propeller blades to allow the propeller to rotate;

r. attaching said truss sections to said truss sections attached to said second integral structure to have said truss sections extend beyond said propeller blades to allow the propeller to rotate;

s. connecting the outer portside truss sections; and, t. connecting the outer starboard truss sections to encompass the propeller blades while allowing the propeller blades to rotate.

57. A method according to claim 56 and comprising:

a. positioning a flexible, yieldable and expandable habitat bag, of such a size as to fit over the upper part of said propeller; and, b. attaching said habitat bag to said truss.

58. A method according to claim 56 and comprising:

a. part of said propeller being in the water; and, b. positioning said truss, in the water, on said propeller shaft in the water.

59. A method according to claim 58 and comprising:

a. positioning a flexible, yieldable and expandable habitat bag, of such a size as to fit over the upper part of said propeller;

b. attaching said habitat bag to said truss; and, c. inflating said habitat bag to fit over and to enclose the upper part of said propeller blades.

60. A method according to claim 57 and comprising:

a. positioning a test instrument inside of said habitat.

61. A method for assembling a truss on the propeller shaft, having a propeller having propeller blades, on a ship and comprising:

a. uniting a first top section and a first bottom section to form a first portside section;

b. uniting a second top section and a second bottom section to form a first starboard section;

c. forming another portside section;

d. forming another starboard section;

e. juxtapositioning said first portside section to the propeller shaft and forwardly of said propeller;

f. juxtapositioning said first starboard section to the propeller shaft and forwardly of said propeller;

g. uniting said first portside section and said first starboard section into a first integral structure;

h. juxtapositioning said another portside section to the propeller shaft and aft of said propeller;

i. juxtapositioning said another starboard section to the propeller shaft and aft of said propeller;

j. uniting said another portside section and said another starboard section into a second integral structure;

k. forming truss sections for attachment to said first integral structure, to said second integral structure and to each other;

l. attaching said truss sections to the portside and to the starboard side of said first integral structure;

m. attaching said truss sections to said truss sections attached to said first integral structure to have said truss sections extend beyond said propeller blades to allow the propeller to rotate;

n. attaching said truss sections to said truss sections attached to said second integral structure to have said truss sections extend beyond said propeller blades to allow the propeller to rotate;

o. connecting the outer portside truss sections; and, p. connecting the outer starboard truss sections to encompass the propeller blades while allowing the propeller blades to rotate.

62. A method according to claim 61 and comprising:

a. positioning a flexible, yieldable and expandable habitat bag, of such a size as to fit over the upper part of said propeller, over said propeller.

63. A method according to claim 62 and comprising:

a. part of said propeller being in water; and, b. positioning said truss, in the water, on said propeller shaft in the water.

64. A method according to claim 63 and comprising:

a. positioning a flexible, yieldable and expandable habitat bag, of such a size as to fit over the upper part of said propeller, over said propeller;

b. attaching said habitat bag to said truss; and, c. inflating said habitat bag to fit over and to enclose the upper part of said propeller blades.

65. A method according to claim 62 and comprising:

a. positioning a test instrument inside of said habitat.

66. A method for assembling a truss on the propeller shaft, having a propeller having propeller blades, on a ship and comprising:

a. uniting a first top section and a first bottom section to form a first portside section;

b. uniting a second top section and a second bottom section to form a first starboard section;

c. forming another portside section;

d. forming another starboard section;

e. uniting said first top section of said first portside section with said second top section of said first starboard section and move apart said first bottom section and said second bottom section to form a first structure;

f. uniting said first top section of said another portside section with said second top section of said another starboard section and move apart said first bottom section of said another portside section and said second bottom section of said another starboard section to form a second structure;

g. positioning said first structure adjacent to said propeller shaft and forwardly of said propeller;

h. moving said first bottom section and said second bottom section of said first structure toward each other and uniting said first bottom section and said bottom section to form a first integral structure;

i. positioning said second structure adjacent to said propeller shaft and aft of said propeller;

j. moving said first bottom section and said second bottom section of said second structure toward each other and uniting said first bottom section and said second bottom section to form a second integral structure;

k. forming truss sections for attachment to said first integral structure, to said second integral structure and to each other;

l. attaching said truss sections to the portside and to the starboard side of said first integral structure;

m. attaching said truss sections to said truss sections attached to said first integral structure to have said truss sections extend beyond said propeller blades to allow the propeller to rotate;

n. attaching said truss sections to said truss sections attached to said second integral structure to have said truss sections extend beyond said propeller blades to allow the propeller to rotate;

o. connecting the outer portside truss sections; and, p. connecting the outer starboard truss sections to encompass the propeller blades while allowing the propeller blades to rotate.

67. A method according to claim 66 and comprising:

a. positioning a flexible, yieldable and expandable habitat bag, of such a size as to fit over the upper part of said propeller, over said propeller.

68. A method according to claim 67 and comprising:

a. part of said propeller being in water; and, b. positioning said truss, in the water, on said propeller shaft in the water.

69. A method according to claim 68 and comprising:

a. positioning a flexible, yieldable and expandable habitat bag, of such a size as to fit over the upper part of said propeller, over said propeller b. attaching said habitat bag to said truss; and, c. inflating said habitat bag to fit over and to enclose the upper part of said propeller blades.

70. A method according to claim 67 and comprising:

a. positioning a test instrument inside of said habitat.

71. A method for assembling a truss on the propeller shaft having a propeller having propeller blades on a ship and comprising:

a. forming a first top section to be positioned on top of the propeller shaft and on the portside of said propeller shaft;

b. forming a second top section to be positioned on top of the propeller shaft and on the starboard side of the propeller shaft;

c. joining said first top section and said second top section to form a first top structure;

d. forming a first bottom section to be positioned underneath said propeller shaft and on the portside of said propeller shaft;

e. forming a second bottom section to be positioned underneath said propeller shaft and on the starboard of said propeller shaft;

f. joining said first bottom section and said second bottom section to form a first bottom structure;

g. forming a second top structure;

h. forming a second bottom structure;

i. identifying said first top structure;

j. identifying said second top structure as a second integral structure;

k. forming truss sections for attachment to said first integral structure, to said second integral structure and to each other;

l. attaching said truss sections to the portside and to the starboard side of said first integral structure;

m. attaching said truss sections to said truss sections attached to said first integral structure to have said truss sections extend beyond said propeller blades to allow the propeller to rotate;

n. attaching said truss sections to said truss sections attached to said second integral structure to have said truss sections extend beyond said propeller blades to allow the propeller to rotate;

o. connecting the outer portside truss sections;

p. connecting the outer starboard truss sections to encompass the propeller blades while allowing the propeller blades to rotate;

q. positioning said substantially complete truss adjacent to said propeller shaft with said first integral structure forward of said propeller and with said second integral structure aft of said propeller;

r. positioning said first bottom section underneath said propeller shaft and forward of said propeller;

s. uniting said first bottom section with said first integral structure;

t. positioning said second bottom section underneath said propeller shaft and aft of said propeller; and, u. uniting said second bottom section with said second integral structure.

72. A method according to claim 71 and comprising:

a. positioning a flexible, yieldable and expandable habitat bag, of such a size as to fit over the upper part of said propeller, over said propeller.

73. A method according to claim 72 and comprising:

a. said propeller shaft and said propeller being in water; and, b. positioning said truss, in the water, on said propeller shaft in the water.

74. A method according to claim 73 and comprising:

a. positioning a flexible, yieldable and expandable habitat bag, of such a size as to fit over the upper part of said propeller, over said propeller, b. attaching said habitat bag to said truss; and, c. inflating said habitat bag to fit over and to enclose the upper part of said propeller blades.

75. A method according to claim 72:

a. positioning a test instrument inside of said habitat.

76. A method for assembling a truss on the propeller shaft, having a propeller having propeller blades, on a ship and comprising:

a. forming a first top section to be positioned on top of the propeller shaft and on the portside of said propeller shaft;

b. forming a second top section to be positioned on top of the propeller shaft and on the starboard side of the propeller shaft;

c. forming another first top section;

d. forming another second top section;

e. forming a first bottom section to be positioned underneath said propeller shaft and on the portside of said propeller shaft;

f. forming a second bottom section to be positioned underneath said propeller shaft and on the starboard side of said propeller shaft;

g. forming another first bottom section;

h. forming another second bottom section;

i. positioning said first top section above said propeller shaft and on the portside of said propeller shaft and forwardly of the propeller;

j. positioning said second top section above said propeller shaft and on the starboard side of said propeller shaft and forwardly of the propeller;

k. uniting said first top section and said second top section to be adjacent to and above said propeller shaft to form a first top structure;

l. positioning said another first top section on the portside of said propeller shaft and aft of the propeller;

m. positioning said another second top section on the starboard side of said propeller shaft and aft of the propeller;

n. uniting said another first top section and said another second top section to be adjacent to and above said propeller shaft to form a second top structure;

o. positioning said first bottom section under said propeller shaft and on the portside of said propeller shaft and forwardly of the propeller;

p. positioning said second bottom section under said propeller shaft and on the starboard side of said propeller shaft and forwardly of the propeller;

q. uniting said first bottom section and said section bottom section to be adjacent to and below said propeller shaft to form a first bottom structure forwardly of the propeller;

r. positioning said another first bottom section under said propeller shaft and on the portside of said propeller shaft and aft of the propeller;

s. positioning said another second bottom section under said propeller shaft and on the starboard side of said propeller shaft and aft of the propeller;

t. uniting said another first bottom section and said another second bottom section to be adjacent to and below said propeller shaft to form a second bottom structure aft of said propeller;

u. uniting said first top structure and said first bottom structure into a first integral structure;

v. uniting said second top structure and said second bottom structure into a second integral structure;

w. forming truss sections for attachment to said first integral structure, to said second integral structure and to each other;

x. attaching said truss sections to the portside and to the starboard side of said first integral structure;

y. attaching said truss sections to said truss sections attached to said first integral structure to have said truss sections extend beyond said propeller blades to allow the propeller to rotate;

z. attaching said truss sections to said truss sections attached to said second integral structure to have said truss sections extend beyond said propeller blades to allow the propeller to rotate;

aa. connecting the outer portside truss sections; and, bb. connecting the outer starboard truss sections to encompass the propeller blades while allowing the propeller blades to rotate.

77. A method according to claim 76 and comprising:

a. positioning a flexible, yieldable and expandable habitat bag, of such a size as to fit over the upper part of said propeller, over said propeller.

78. A method according to claim 76 and comprising:

a. part of said propeller being in water; and, b. positioning said truss, in the water, on said propeller shaft in the water.

79. A method according to claim 78 and comprising:

a. positioning a flexible, yieldable and expandable habitat bag, of such a size as to fit over the upper part of said propeller, over said propeller;

b. attaching said habitat bag to said truss; and, c. inflating said habitat bag to fit over and to enclose the upper part of said propeller blades.

80. A method according to claim 76 and comprising:

a. positioning a test instrument inside of said habitat.

81. A process for evaluating a propeller on the propeller shaft on a ship and comprising:

a. assembling truss sections to form a truss for operatively connecting with said ship and to be juxtapositioned to said propeller and said propeller shaft;

b. supporting said truss on said propeller shaft;

c. positioning over the upper part of said propeller a habitat bag;

d. inside of said habitat bag evaluating said propeller.

82. A process according to claim 81 and comprising:

a. repairing said propeller.

83. A process according to claim 81 and comprising:

a. assembling said truss sections to encompass said propeller while allowing said propeller to rotate.

84. A process according to claim 81 and comprising:

a. positioning said ship in water with part of said propeller in the water;

b. selecting a habitat bag which is flexible, yieldable and expandable; and, c. introducing gaseous fluid into said habitat bag for inflating said habitat bag with said gaseous fluid.

85. A process according to claim 84 and comprising:

a. repairing said propeller.

86. A propeller on the propeller shaft on a ship evaluated by a process comprising:

a. assembling truss sections to form a truss for operatively connecting with said ship and to be juxtapositioned to said propeller and said propeller shaft;

b. supporting said truss on said propeller shaft;

c. positioning over the upper part of said propeller a habitat bag; and, d. inside of said habitat bag evaluating said propeller.

87. A propeller on the propeller shaft on a ship evaluated by a process according to claim 86 and comprising:

a. repairing said propeller.

88. A propeller on the propeller shaft on a ship evaluated by a process according to claim 86 and comprising:

a. assembling said truss sections to encompass said propeller while allowing said propeller to rotate.

89. A propeller on the propeller shaft on a ship evaluated by a process according to claim 86 and comprising:

a. positioning said ship in water with said propeller in the water and said truss in the water;

b. selecting a habitat bag which is flexible, yieldable and expandable; and, c. introducing gaseous fluid into said habitat bag for inflating said habitat bag with said gaseous fluid.

90. A propeller on the propeller shaft on a ship evaluated by a process according to claim 86 and comprising:

a. repairing said propeller.

* * * * *